US008369729B2

(12) United States Patent
Torimaru

(10) Patent No.: US 8,369,729 B2
(45) Date of Patent: Feb. 5, 2013

(54) IMAGE FORMING APPARATUS WITH VARYING TRANSFER BIAS

(75) Inventor: Yuusuke Torimaru, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 89 days.

(21) Appl. No.: 12/813,987

(22) Filed: Jun. 11, 2010

(65) Prior Publication Data

US 2010/0322652 A1 Dec. 23, 2010

(30) Foreign Application Priority Data

Jun. 18, 2009 (JP) ..... 2009-145308

(51) Int. Cl.
*G03G 15/16* (2006.01)

(52) U.S. Cl. ..... 399/66

(58) Field of Classification Search ..... 399/66, 399/49, 72

See application file for complete search history.

(56) References Cited

U.S. PATENT DOCUMENTS

| | | | | |
|---|---|---|---|---|
| 5,926,669 | A * | 7/1999 | Sugimoto et al. | 399/66 |
| 5,991,558 | A | 11/1999 | Emi et al. | |
| 2009/0067864 | A1 * | 3/2009 | Shirafuji | 399/66 |
| 2009/0196638 | A1 | 8/2009 | Sukesako et al. | |

FOREIGN PATENT DOCUMENTS

| | | |
|---|---|---|
| JP | 7-244412 | 9/1995 |
| JP | 10-326031 | 12/1998 |
| JP | 2009-48160 | 3/2009 |

* cited by examiner

*Primary Examiner* — Walter L Lindsay, Jr.
*Assistant Examiner* — Billy J Lactaoen
(74) *Attorney, Agent, or Firm* — Fitzpatrick, Cella, Harper & Scinto

(57) ABSTRACT

An image forming apparatus includes an image forming device for forming a toner image on an image conveying member on the basis of an input image signal; a transfer device for transferring the toner image from the image conveying member onto an image receiving member; a bias applying device for applying a transfer bias to the transfer device when the toner image is transferred from the image conveying member onto the image receiving member; an executing portion for executing a test mode in which a test image is formed on the image conveying member and is then transferred onto the image receiving member; a detecting device for detecting a current passing through the transfer device in the test mode; a control device for controlling an image forming condition of the image forming device on the basis of an output of the detecting device; and a setting device for setting a test bias to be applied from the bias applying device at a value larger than the transfer bias in terms of an absolute value.

9 Claims, 13 Drawing Sheets

IMAGE FORMING APPARATUS WITH VARYING TRANSFER BIAS

FIELD OF THE INVENTION AND RELATED ART

The present invention relates to an image forming apparatus for adjusting an image forming condition of a toner image by detecting a test image formed under a predetermined image forming condition. Specifically, the present invention relates to control of measurement of a toner amount per unit area of the test image having a high image density for which sufficient sensitivity is not obtained by an optical sensor.

The image forming apparatus in which the test image (patch image) formed under the predetermined image forming condition is detected by the optical sensor is measured and fed back to the image forming condition of the toner image has been widely used. The optical sensor is disposed opposed to a photosensitive drum and detects reflected light by irradiating the test image with infrared light, thus outputting an output signal corresponding to the toner amount (per unit area) of the test image (Japanese Laid-Open Patent Application (JP-A) Hei 10-326031).

The optical sensor outputs the output signal corresponding to the toner amount by decreasing specularly reflected light through scattering of incident light by toner particles deposited on a surface. For this reason, in the case where the high-density test image for which the surface of the photosensitive drum is covered with the toner particles and the specularly reflected light from the photosensitive drum surface is not obtained, the specularly reflected light is not so changed even when the toner amount is changed, so that an estimated error of the toner amount is increased. For this reason, the test image such that the specularly reflected light from the photosensitive drum surface is obtained by using area coverage modulation (screen pattern) is used (JP-A Hei 7-244412).

In the case of toner supply control for adjusting the amount of the toner supplied to a developing device so that a charge amount (Q/M) of the toner is a predetermined value, the control can be effected with sufficient accuracy even when the image density of the test image is at a half-tone level (so-called patch detection ATR (auto toner replenish control).

On the other hand, in the case of image density control for setting a maximum density of an output image by adjusting a developing contrast of the toner image by using the test image, it is desirable that the test image having the image density close to a maximum image density is formed and is subjected to measurement of the toner amount. In other words, it is desirable that the toner amount of the test image formed as a so-called solid image by which the photosensitive drum surface is covered at an area gradation level of 100% with no blank space is measured in the neighborhood of an area in which the toner amount corresponds to the maximum image density.

However, as described in JP-A Hei 7-244412, with respect to the test image increased in toner amount with which the photosensitive drum surface is covered with no blank space, sufficient output sensitivity cannot be obtained by the optical sensor (FIG. 4). With respect to a thick test image having the image density close to the maximum image density, the specularly reflected light and scatteringly reflected light are little changed. Therefore, a difference in toner amount cannot be detected, so that detection accuracy of the toner amount is liable to lower.

SUMMARY OF THE INVENTION

A principal object of the present invention is to provide an image forming apparatus capable of enhancing detection accuracy of an image density with respect to a high-density toner image for which a detection resolution of an optical sensor is low.

According to an aspect of the present invention, there is provided an image forming apparatus comprising:

image forming means for forming a toner image on an image conveying member on the basis of an input image signal;

transfer means for transferring the toner image from the image conveying member onto an image receiving member;

bias applying means for applying a transfer bias to the transfer means when the toner image is transferred from the image conveying member onto the image receiving member;

executing means for executing a test mode in which a test image is formed on the image conveying member and is then transferred onto the image receiving member;

detecting means for detecting a current passing through the transfer means in the test mode;

control means for controlling an image forming condition of the image forming means on the basis of an output of the detecting means; and setting means for setting a test bias to be applied from the bias applying means at a value larger than the transfer bias in terms of an absolute value.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinbelow, embodiments of the present invention will be specifically described with reference to the drawings. The present invention can also be carried out in other embodiments in which a part or all of constitutions in the following embodiments are replaced with alternative constitutions so long as a voltage having a range in which a transfer efficiency of a toner image is lowered on a high voltage side is applied to a transfer portion during measurement of the toner image.

In the following embodiment, only a principal portion of an image forming apparatus relating to formation and transfer of a toner image will be described but the present invention can be carried out in various fields of uses such as printers, various printing machines, copying machines, facsimile machines, and multi-function machines by adding necessary device, equipment, and casing structure.

Incidentally, with respect to general matters of image forming apparatuses described in JP-A Hei 10-326031 and JP-A Hei 7-244412 will be omitted from illustration and redundant description.

(Image Forming Apparatus)

Figure 1:
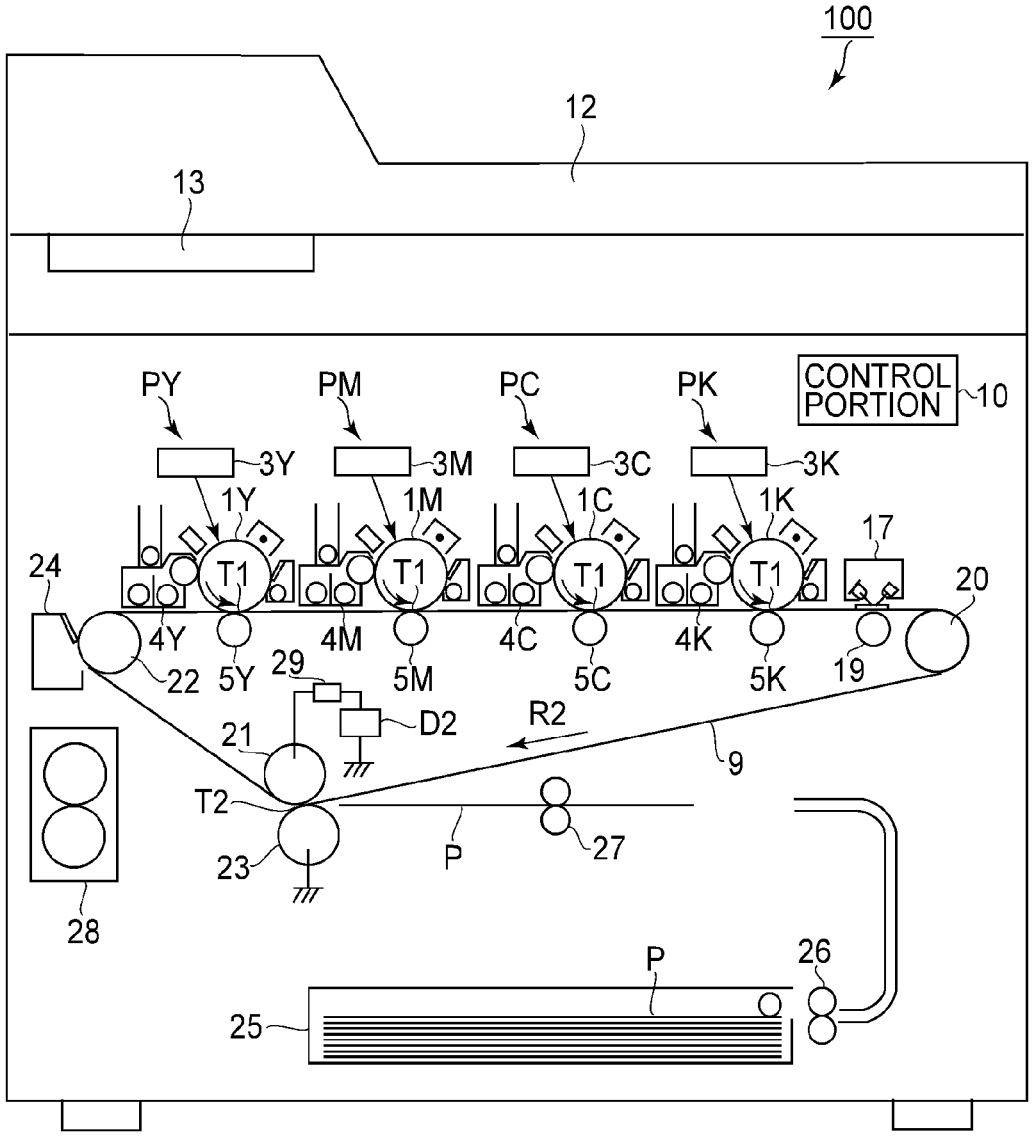
FIG. 1 is an illustration of a structure of an image forming apparatus.
Figure 2:
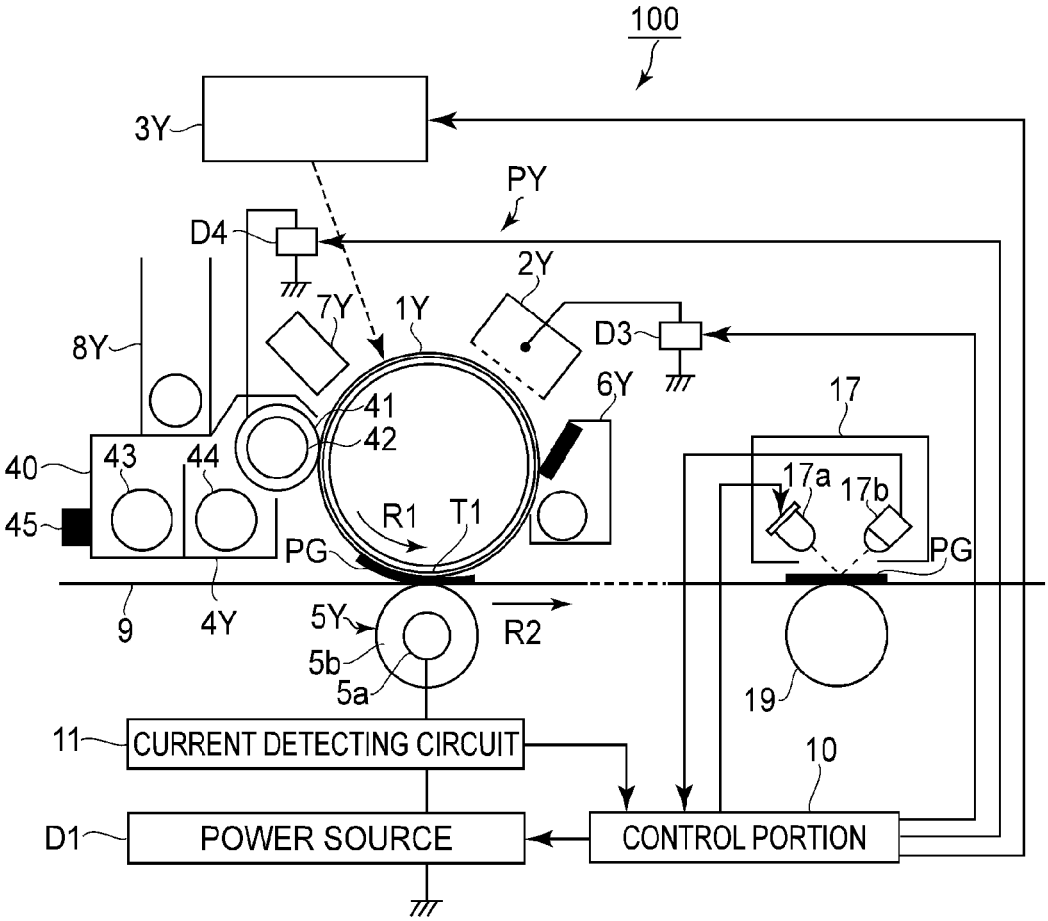
FIG. 2 is an illustration of a structure of an image forming portion.
Figure 3:
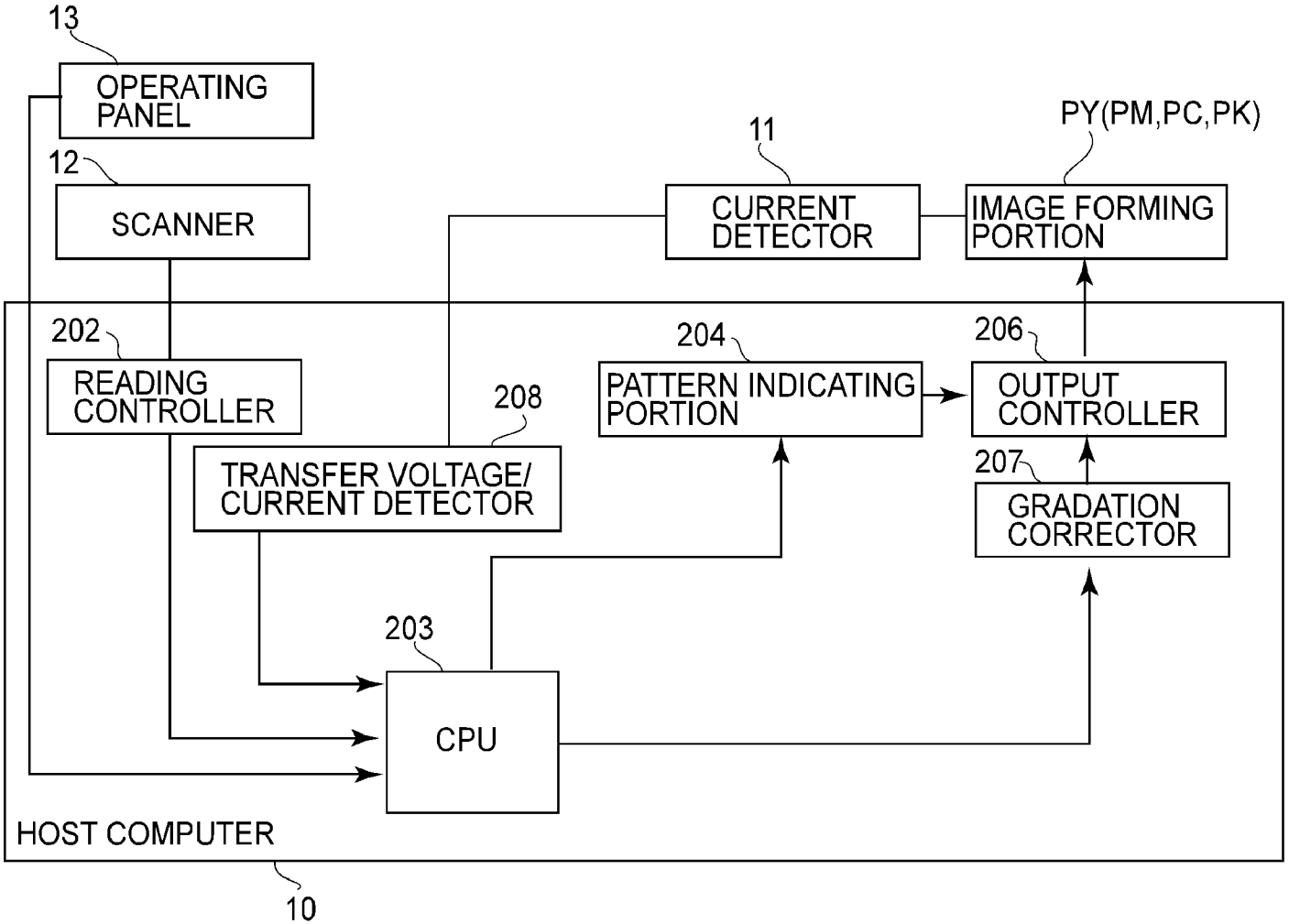
FIG. 3 is a block diagram of a control system of the image forming apparatus.

FIG. 1 is an illustration of a structure of the image forming apparatus. FIG. 2 is an illustration of a structure of an image forming portion. FIG. 3 is a block diagram of a control system of the image forming apparatus.

As shown in FIG. 1, an image forming apparatus 100 is a full-color printer of a tandem and intermediary transfer type in which image forming portions PY, PM, PC and PK for yellow, magenta, cyan and black, respectively are arranged along an intermediary transfer belt 9. Each of the image forming portions (image forming means) PY, PM, PC and PK forms a toner image on an image conveying member on the basis of an input image signal. Here, the input image signal means a signal input from an image reader in the case of the copying machine and a signal input from an input terminal (such as a personal computer (PC)) connected with a printer through a network cable in the case of the printer.

At the image forming portion PY, a yellow toner image is formed on a photosensitive drum 1Y and then is primary-transferred onto the intermediary transfer belt 9. At the image forming portion PM, a magenta toner image is formed on a photosensitive drum 1M and then is superposedly primary-transferred onto the yellow toner image on the intermediary transfer belt 9. At the image forming portions PC and PK, a cyan toner image and a black toner image are formed on photosensitive drums 1C and 1K, respectively, and then are superposedly primary-transferred successively onto the intermediary transfer belt 9.

The four color toner images primary-transferred onto the intermediary transfer belt 9 are conveyed to a secondary transfer portion T2, at which the toner images are collectively secondary-transferred onto the recording material P. The recording material P on which the four color toner images are secondary-transferred is subjected to heat pressing by a fixing device 28, so that the toner images are fixed on the surface of the recording material P. Thereafter, the recording material P is discharged to the outside of the image forming apparatus 100.

The intermediary transfer belt 9 is stretched around and supported by a tension roller 22, a driving roller 20 and an opposite roller 21 and is driven by the driving roller 20 to be rotated in an arrow R2 direction at a process speed of 140 mm/sec. The intermediary transfer belt 9 is formed of a material adjusted in volume resistivity of $10^9$ to $10^{14}$ Ω·cm by incorporating carbon black particles as an antistatic agent into a various resin or rubber materials such as polycarbonate and has a thickness of 0.07 to 0.5 mm.

The recording material P drawn from a recording material cassette 25 is separated one by one by separation rollers 26 and then is sent to registration rollers 27.

The registration rollers 27 receive the recording material P in a rest state and place the recording material P in a stand-by state and feed the recording material P toward the secondary transfer portion T2 while timing the recording material P to the toner image on the intermediary transfer belt 9.

A secondary transfer roller 23 contacts the intermediary transfer belt 9 supported by the opposite roller 21 to form the secondary transfer portion T2. A DC voltage of a positive polarity is applied to the secondary transfer roller 23, so that the four color toner images which have been negatively charged and carried on the intermediary transfer belt 9 are secondary-transferred onto the recording material P.

The secondary transfer roller 23 is formed similarly as in the case of a primary transfer roller 5Y as a transfer member described later and includes a 2-10 μm thick coating layer of a resin material, such as urethane resin or nylon resin, as a surface layer. The secondary transfer roller 23 is pressed against the intermediary transfer belt 9 toward the opposite roller 21 with a total pressure of 15 to 50N at both end portions thereof.

When the toner images carried on the intermediary transfer belt 9 is secondary-transferred onto the recording material P, to the opposite roller 21, the DC voltage of an identical polarity to the toner charge polarity is applied from a power source D2. For example, the negative voltage of −1000 V to −3000 V is applied, so that a current of −10 μA to −50 μA passes through the secondary transfer portion T2. The DC voltage at this time is detected by a voltage detecting circuit 29.

A bias cleaning device 24 rubs the intermediary transfer belt 9 with a cleaning blade to collect transfer residual toner which has passed through the secondary transfer portion T2 without being transferred onto the recording material P and remains on the intermediary transfer belt 9.

The image forming portions PY, PM, PC and PK have the substantially same constitution except that the colors of toners of yellow for a developing device 4Y provided in the image forming portion PY, magenta for a developing device 4M provided in the image forming portion PM, cyan for a developing device 4C provided in the image forming portion PC, and black for a developing device 4K provided in the image forming portion PK are different from each other. In the following description, the image forming portion PY for yellow will be described and with respect to other image forming portions PM, PC and PK, the suffix Y of reference numerals (symbols) for representing constituent members (means) is to be read as M, C and K, respectively, for explanation of associated ones of the constituent members.

As shown in FIG. 2, the image forming station PY includes the photosensitive drum 1Y. Around the photosensitive drum 1Y, a charging device 2Y, an exposure device 3Y, the developing device 4Y, a primary transfer roller 5Y, and a cleaning device 6Y are disposed in the image forming portion PY.

The photosensitive drum 1Y includes an aluminum cylinder and a photoconductive layer having a negative charge polarity formed on an outer peripheral surface of the aluminum cylinder, and is rotated in a direction of an arrow R1 at a process speed of 140 mm/sec. The charging device 2Y employs a corona charger and adjusts an amounts of irradiation of the photosensitive drum 1Y with charged particles by the corona discharge on the basis of feed-back from the potential sensor 7Y, so that the surface of the photosensitive drum 1Y is electrically charged uniformly to a negative-polarity dark portion potential VD.

The exposure device 3Y writes (forms) an electrostatic image for an image on the charged surface of the photosensitive drum 1Y by scanning of the charged surface through a rotating mirror with a laser beam obtained by ON/OFF modulation of scanning line image data expanded from a separated color image for yellow.

In the developing device 4Y, a two component developer containing non-magnetic yellow toner and a magnetic carrier in mixture is filled in a developing container 40. A stirring screw 43 and a feeding screw 44 circulate the two component developer while stirring the two component developer, so that the non-magnetic carrier is negatively charged and the magnetic toner is positively charged. A developing sleeve 41 rotates around a fixed magnet roller 42 and carries the charged two component developer on its surface by the magnetic force of the magnet roller 42 to cause an erected chain of the two component developer to slide on the photosensitive drum 1Y. A power source D4 applies to the developing sleeve 41 an oscillating voltage in the form of a negative Vdc voltage biased with the AC voltage Vpp. As a result, the negatively charged toner is transferred from the developing sleeve 41 onto an exposed portion having a light portion potential VL on the photosensitive drum 1Y which is positively charged relative to the developing sleeve 41, so that the electrostatic image is reversely developed.

A potential difference between the light portion potential VL of the photosensitive drum 1Y and the DC voltage Vdc applied to the developing sleeve 41 is developing contrast Vcont. A potential difference between the dark portion potential VD and the DC voltage Vdc applied to the developing sleeve 41 is fog-removing contrast Vback. On the electrostatic image on the photosensitive drum 1Y, the toner is deposited in the amount corresponding to the charge amount of the developing contrast Vcont.

The toner amount of the toner image developed from the electrostatic image is increased by increasing the developing contrast Vcont and is decreased by decreasing the developing contrast Vcont.

The developing contrast Vcont can be increased by increasing the dark portion potential VD and the DC voltage Vdc while keeping the fog-removing contrast Vback at a constant value. Further, it is also possible to increase the developing contrast Vcont by increasing an exposure output (laser beam intensity) while keeping the dark portion potential VD and the DC voltage Vdc.

A supplying device 8Y supplies to the developing container a supply developer (toner 100%) in an amount corresponding to the toner amount consumed in the developing device 4Y every image formation. The supply device 8Y adjusts the amount of the supply developer to be supplied to the developing container 40 on the basis of an output of a (magnetic) permeability sensor 45 to keep a toner content, (a weight ratio of the toner to the two component developer) of the two component developer circulated in the developing device 4Y, within a predetermined range.

The cleaning device 6Y causes a cleaning blade to slide on the photosensitive drum 1Y to collect the transfer residual toner without being transferred onto the intermediary transfer belt 9.

As shown in FIG. 3, the image forming apparatus 100 includes a scanner 12, an operating panel 13, the image forming portion PY (PM, PC, PK) and the control portion 10. The control portion 10 operates the operating panel 13 to read the image with the scanner 12, and can adjust the image forming condition of the image forming portion PY (PM, PC, PK) on the basis of a result of the reading.

(Optical Sensor)

Figure 4:
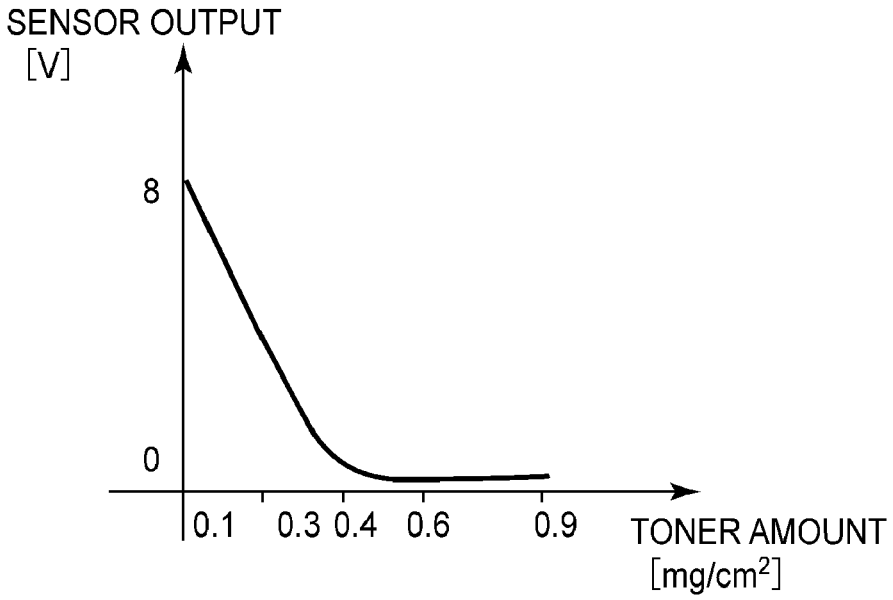
FIG. 4 is a graph showing a relationship between an output of an image density sensor and a toner amount per unit area of a toner image.

FIG. 4 is a graph showing a relationship between an output of the image density sensor and the toner amount of the toner image.

As shown in FIG. 2, an optical sensor (image density sensor) 17 detects reflected light corresponding to the toner amount by irradiating a test image (toner image) PG transferred onto the intermediary transfer belt (image receiving member) 9 with predetermined detection light. The image density sensor 17 is disposed opposed to the tension roller 19 through the intermediary transfer belt 9 and detects the test image PG primary-transferred onto the intermediary transfer belt 9 to output an output signal corresponding to the toner amount.

The image density sensor 17 emits infrared light from a light source 17*a* to irradiate the test image PG with the infrared light and detects specularly reflected light from the test image PG by a light-receiving element 17*b*. Further, the image density sensor 17 detects scatteringly reflected from the test image PG by an unshown light-receiving element and corrects a difference in reflected light amount of the specularly reflected light due to a difference in hue of the toner.

The control portion executes a test mode in which the test image (toner image) PG is formed on the photosensitive drum under a predetermined image forming condition and is primary-transferred onto the intermediary transfer belt 9, and then is detected by the image density sensor 17. In the test mode, the toner amount of the test image PG formed on the photosensitive drum 1Y is estimated on the basis of the output signal from the image density sensor 17, so that the image forming condition is adjusted so that the toner amount is a predetermined value.

As shown in FIG. 4, the output signal of the image density sensor 17 is saturated when the toner amount of the test image PG exceeds 0.4 mg/cm$^2$, so that it is impossible to accurately measure the toner amount. For this reason, the test image having the toner amount of 0.6 mg/cm$^2$ corresponding to a target reflection density of 1.6 cannot be measured.

Incidentally, in the case where an exposure output as one of the image forming conditions is changed, the reflection density of the fixed image is changed. This is because the developing contrast Vcont which is the potential difference between the light portion potential VL at the exposed portion of the photosensitive drum 1Y and the DC voltage Vdc applied to the developing sleeve 41 is changed and thus the toner amount of the test image formed on the photosensitive drum 1Y is changed.

Further, with respect to values of image data, in order to ensure reproducibility of the image density of the fixed image which has been actually output, there is need to set the exposure output so that a maximum image density is a predetermined value. As a conventional setting method of the exposure output, there is a method of forming many test images different in exposure output at a plurality of levels by arranging the test images on the recording material P in a predetermined pattern. According to this method, the test images are read by the scanner 12 and the exposure output and a gamma characteristic are automatically adjusted, so that the image data can be associated with the image density of the fixed image from a maximum value to a minimum value.

However, the method in which the fixed image is formed on the recording material P and the image density thereof is read is accompanied with the down time and therefore the productivity of the image forming apparatus is lowered, so that it is difficult to carry out the method with a high frequency.

In view of this problem, a method in which the test image PG with the toner amount of about 0.3 mg/cm$^2$ which is sufficiently sensitive to the image density sensor 17 is formed and the exposure output for the maximum image density is presumptively set has been proposed. When the method in which the test image PG is formed and detected by the image density sensor 17 is carried out, it can be performed in a short time without consuming the recording material P and thus can be performed even at an interval between image formation and subsequent image formation during a continuous image forming operation.

However, with respect to the test image PG with the toner amount of 0.3 mg/cm$^2$, it has been found that the reflection density of the fixed image is about 0.8 and therefore the exposure output corresponding to the reflection density of 1.6 cannot be set so accurately.

In view of this, in the image forming apparatus 100, the measurement of the toner amount is allotted to the image density sensor 17 with respect to less than 0.4 mg/cm$^2$ and the primary transfer constitution with respect to not less than 0.4 mg/cm$^2$.

That is, as shown in FIG. 2, the transfer member 5Y transfers the toner image formed on the image conveying member 1Y by the image forming portion PY onto the image receiving member 9. The power source D1 as a bias applying means applies the transfer bias to the transfer member 5Y when the test image based on the image signal is transferred from the image conveying member 1Y onto the image receiving member 9. Then, the executing portion 10 executes the test mode in which the test image is formed on the image conveying member 1Y and is transferred onto the image receiving member 9. Further, the setting portion 10 sets a test bias, to be applied from the power source D1 in the test mode, at a value larger than the transfer bias in terms of an absolute value. The power source D1 can apply a plurality of set transfer biases used for the image formation but the test bias set with respect to the bias applying means (power source) D1 by the executing portion (setting portion) 10 is larger than the maximum of the plurality of set transfer biases. In this embodiment, the control portion has the functions of these executing portion and setting portion.

In the test mode, a current detecting circuit 11 as a detecting portion detects a current passing through the transfer member 5Y and the control portion 10 controls a subsequent image forming condition of the image forming portion PY on the basis of an output of the current detecting circuit 11.

Further, the power source D1 applies the transfer bias so that the transfer efficiency from the image conveying member 1Y onto the image receiving member 9 is 90% or more and applies the test bias so that the transfer efficiency from the image conveying member 1Y onto the image receiving member 9 is less than 90%.

As a result, it becomes possible to accurately measure the toner amount within the entire image density range, so that the toner amount can be measured with a sufficient detection resolution even when the toner amount is about 0.6 g/cm$^2$ corresponding to the reflection density of 1.6. By using the known primary transfer constitution, it is possible to set the developing contrast Vcont providing the maximum image density without adding an expensive measuring device with the use of the test image PG such that it provides the toner amount exceeding 0.6 mg/cm$^2$.

(Transfer Portion)

Figure 5:
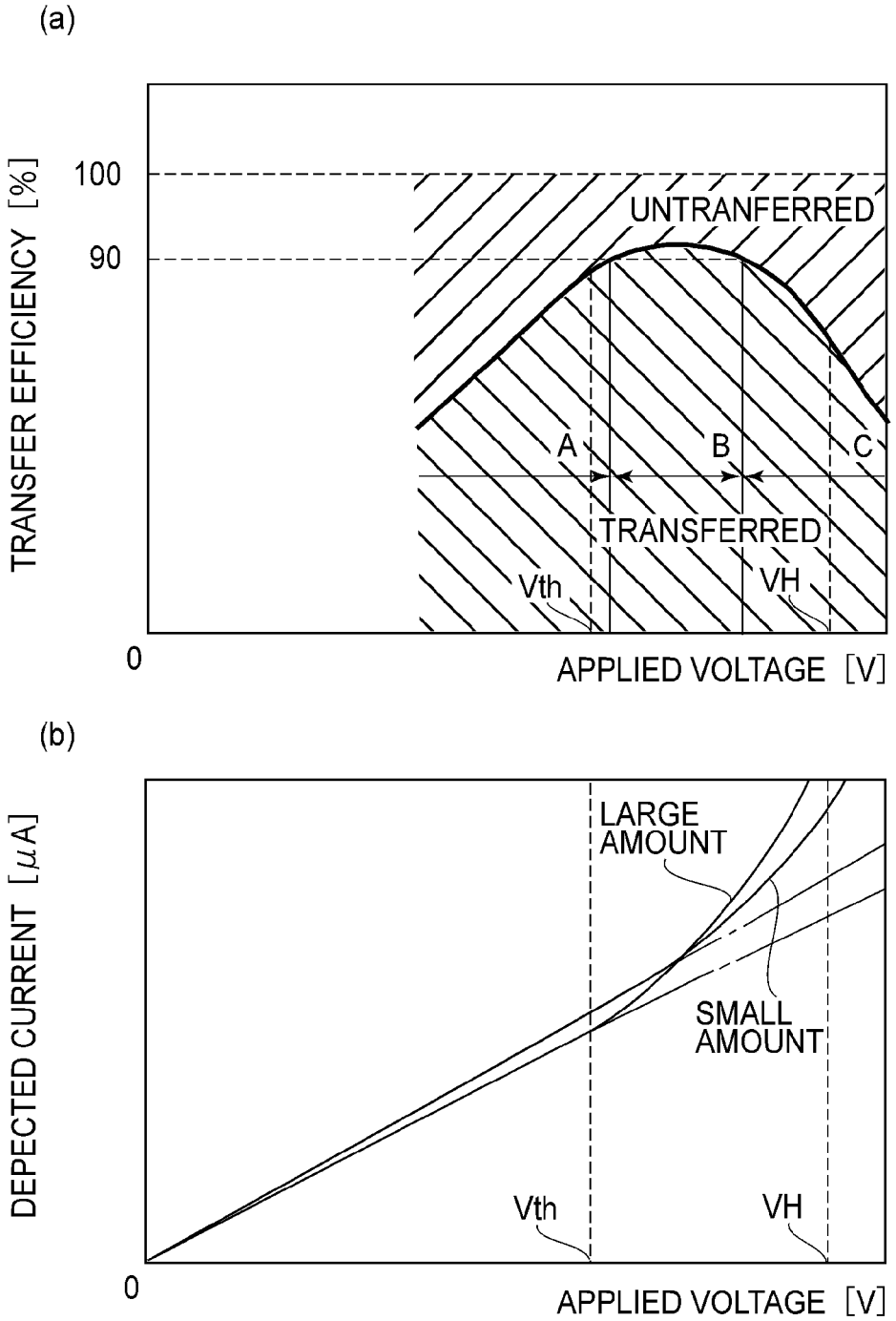
FIG. 5(*a*) is a graph showing a relationship between a transfer voltage and a transfer efficiency and FIG. 5(*b*) is a graph showing a relationship between the transfer voltage and a detected current.

FIG. 5(*a*) is a graph showing a relationship between the transfer voltage and the transfer efficiency and FIG. 5(*b*) is a graph showing a relationship between the transfer voltage and a detected current.

As shown in FIG. 2, the primary transfer roller 5Y presses an inner surface of the intermediary transfer belt 9 to create the primary transfer portion T1 between the photosensitive drum 1Y and the intermediary transfer belt 9. By applying the positive-polarity DC voltage from the power source (bias applying means) D1 to the primary transfer roller 5Y, the negative-polarity toner image carried on the photosensitive drum 1Y is primary-transferred onto the intermediary transfer belt 9 at the primary transfer portion T1.

The primary transfer roller 5Y is formed in an outer diameter of 16-30 mm by disposing an elastic layer 5*b* of an electroconductive rubber material having a sponge texture on an outer peripheral surface of a core metal 5*a* having an outer diameter of 8-12 mm. The elastic layer 5*b* is formed of a polymer elastomer or foam material such as a hydrin rubber or EPDM and is adjusted to have electroconductivity corresponding to a medium resistance of 1 MΩ to 100 MΩ by mixing an ion conductive substance into a base material. The primary transfer roller 5Y has an Asker C hardness of 25-40 degrees as a whole and is pressed against the intermediary transfer belt 9 toward the photosensitive drum 1Y at both end portions thereof with a total pressure of 6-15 N.

As shown in FIG. 5(*a*), the transfer efficiency of the toner image at the primary transfer portion T1 is changed depending on the DC voltage applied to the primary transfer roller 5Y. That is, on a low voltage side A where the DC voltage is low and therefore a necessary transfer current cannot be obtained, the toner image remains on the photosensitive drum 1Y, so that the toner image is not sufficiently primary-transferred onto the intermediary transfer belt 9 (insufficient transfer). Then, with an increasing DC voltage, the transfer efficiency becomes larger but is excessively increased on a high voltage side C where the applied voltage exceeds a discharge start voltage Vth, so that the transfer efficiency is liable to be rather lowered.

Figure 9:
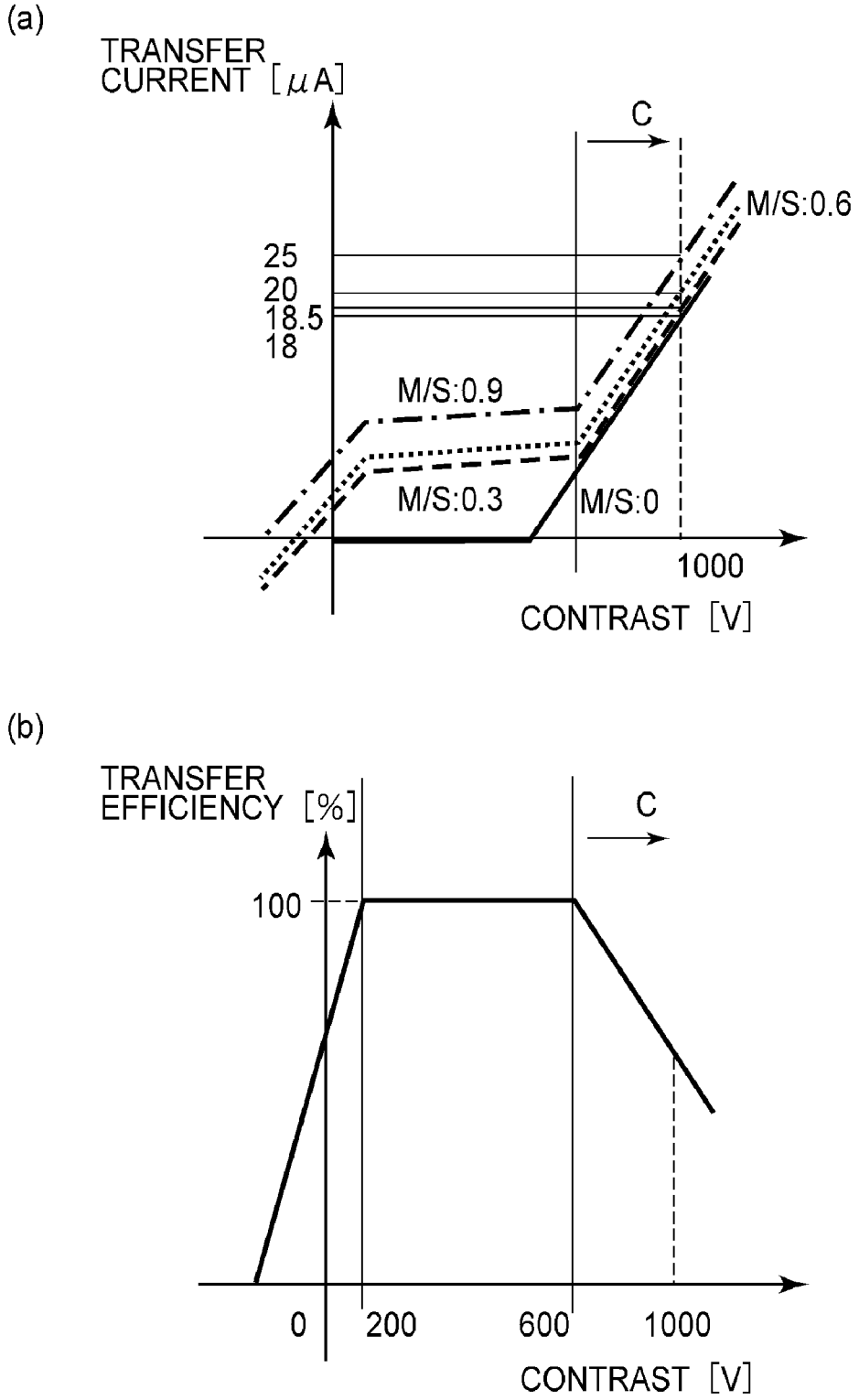
FIGS. 9(*a*) and 9(*b*) are graphs for illustrating the detected current in the test mode.

Here, the discharge start voltage Vth means a voltage at which electric discharge occurs between the primary transfer roller 5Y and the light portion potential VL portion of the photosensitive drum 1Y. In the case where the discharge start voltage Vth is converted into the potential difference, it is necessary to add an absolute value (215 V as an initial value in this embodiment) of the light portion potential VL. Further, on the high voltage side C, the applied transfer voltage is larger than a normal transfer voltage and therefore the transfer efficiency is lowered (from 90% in this embodiment). In this case, a lower limit of the applied transfer voltage is 600 V as shown in FIG. 9(*a*). This is because in the area on the high voltage side C in which the primary transfer contrast is made higher than that in a proper range B and therefore the transfer efficiency is lowered, a slope with respect to the toner amount of 0 mg/cm$^2$ and those with respect to the toner amounts of 3 mg/cm$^2$, 5 mg/cm$^2$ and 9 mg/cm$^2$ are close to each other as shown in FIG. 9(*a*).

That is, the transfer current when the toner amount is 0 mg/cm$^2$ is taken as a reference current and a difference between the reference current and the transfer current when the toner amount is a positive is obtained, so that it is possible to eliminate a factor other than the difference in toner amount. In this case, an upper limit of the applied transfer voltage is a value (2 kV in this embodiment) within a range in which the photosensitive drum 1Y is properly charged to the charge potential, i.e., a range in which a so-called transfer memory is not caused to occur.

On the high voltage side C where the applied transfer voltage exceeds the discharge start voltage Vth, the electric discharge at the primary transfer portion T1 is noticeable, so that charge injection into the intermediary transfer belt 9 due to the presence of the toner which has been primary-transferred onto the intermediary transfer belt 9 occurs. As a result, the charge polarity of the toner is inverted on the intermediary transfer belt 9, so that the toner is returned back to the photosensitive drum 1Y (back-transfer).

For this reason, during the image formation, a voltage in the proper range B in which the voltage exceeds the discharge start voltage Vth but the transfer efficiency is not substantially started to lower is applied to the primary transfer roller 5Y, so that the primary transfer from the photosensitive drum 1Y onto the intermediary transfer belt 9 is performed with a peak transfer efficiency of 90% to 95%. The voltage to be applied to the primary transfer roller 5Y is set in advance of the image formation so that such a transfer current passes through the primary transfer portion T1. The voltage within this proper range B (in which the transfer efficiency is 90% or more in this embodiment) is a normal transfer voltage.

As shown in FIG. 5(*b*), until the applied voltage reaches the discharge start voltage Vth, the current passing through the primary transfer portion T1 is increased in proportion to the voltage applied to the primary transfer roller 5Y. However, when the applied voltage exceeds the discharge start voltage Vth, the electric discharge becomes active on an upstream side and downstream side of a range in which the primary transfer roller 5Y and the photosensitive drum 1Y contact each other, so that a range in which the current flows is enlarged. Therefore, the amount of the current is increased in a quadric function manner.

That is, when the applied voltage is increased to exceed the discharge start voltage Vth, a contact area between the primary transfer roller 5Y and the photosensitive drum 1Y is apparently increased, so that the current passing through the primary transfer roller 5Y is increased.

Here, according to an experiment, the current passing through the primary transfer portion T1 becomes higher in amount with an increasing toner amount of the toner image carried on the photosensitive drum 1Y. This phenomenon may be attributable to enlargement of the output flowing range due to occurrence of the electric discharge a frequency of which is higher with the increasing toner amount of the toner image carried on the photosensitive drum 1Y. For this reason, when the current at the time of transferring the toner image onto the image receiving member 9 by using a voltage VH in the area on the high voltage side, it is possible to measure the toner amount of the toner image which has been carried on the photosensitive drum 1Y.

That is, the primary transfer by which the transfer efficiency is intentionally lowered is performed by using the voltage VH, in the area on the high voltage side C, which is improper voltage for the primary transfer of the toner image, so that measurement data for estimating the toner amount of the toner image is obtained.

However, the transfer efficiency is lowered and therefore the amount of the toner remaining on the photosensitive drum 1Y is increased, so that the toner amount of the test image GP transferred onto the intermediary transfer belt 9 is no longer equal to that of the test image GP which has been found on the photosensitive drum 1Y. For this reason, in the case where the toner amount is measured by using the image density sensor 17, it is necessary to primary-transfer the toner image onto the intermediary transfer belt 9 with a high transfer efficiency by applying the voltage in the proper range B to the primary transfer roller 5Y.

<Embodiment 1>

Figure 7:
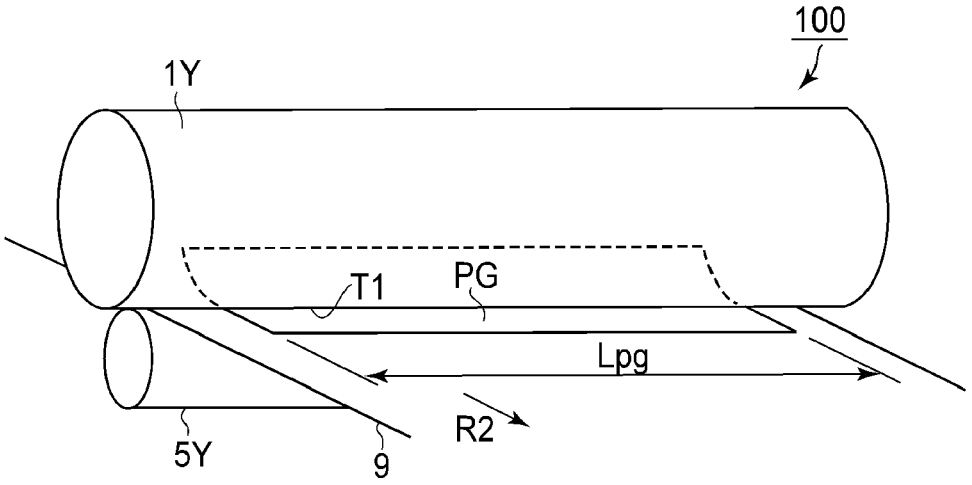
FIG. 7 is a schematic view for illustrating primary transfer of a test image.
Figure 6:
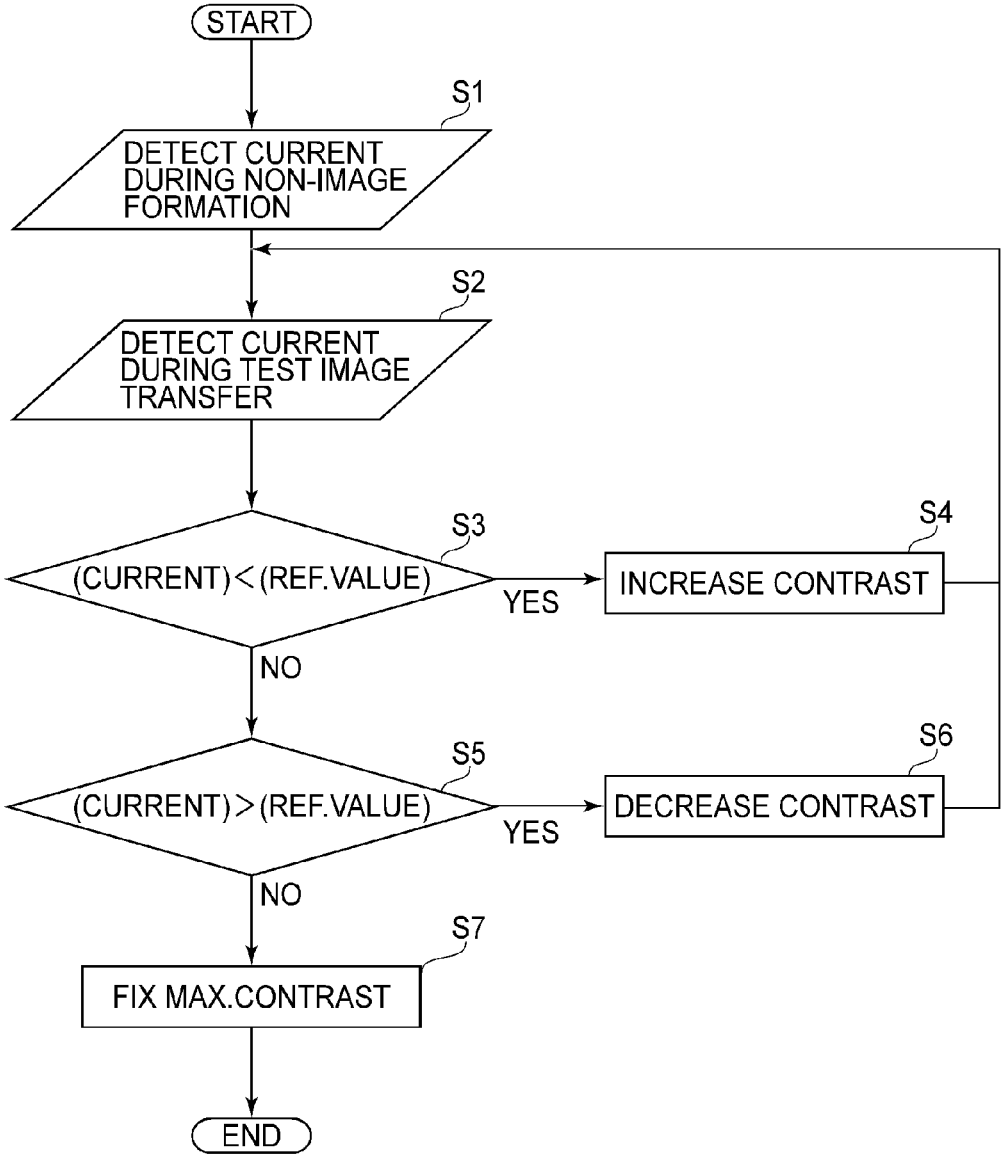
FIG. 6 is a flow chart for illustrating image density adjustment in Embodiment 1.
Figure 8:
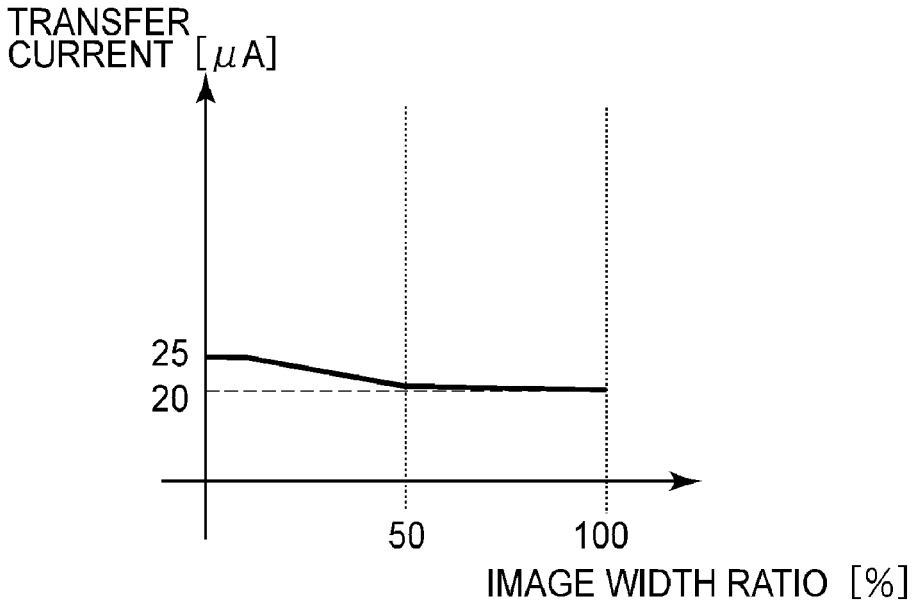
FIG. 8 is a graph for illustrating the test image in a test mode.
Figure 10:
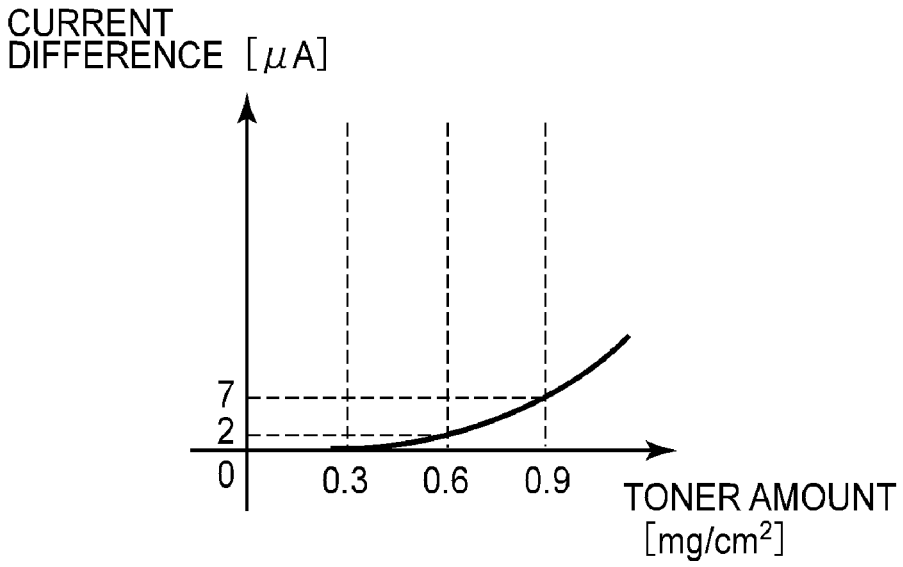
FIG. 10 is a graph showing a relationship between a difference in detected current and the toner amount.
Figure 11:
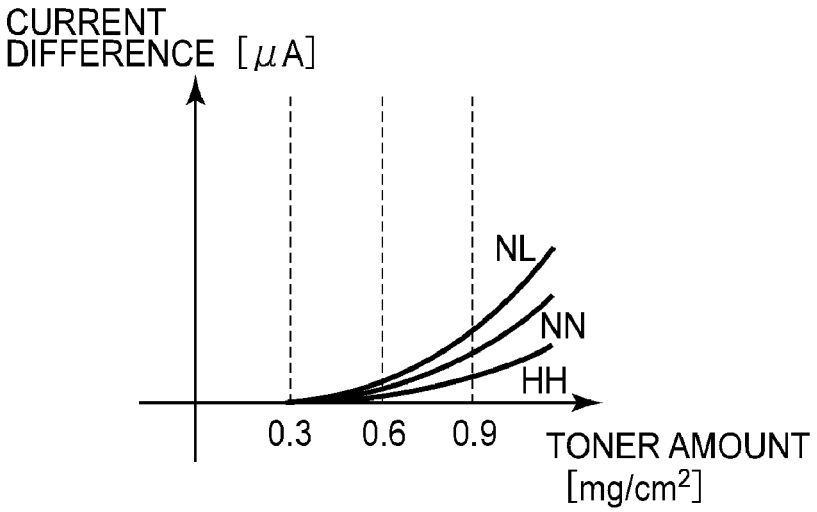
FIG. 11 is a graph showing a relationship between the difference in detected current and the toner amount under several environment conditions.

FIG. 6 is a flow chart for illustrating image density adjustment in this embodiment. FIG. 7 is a schematic view for illustrating primary transfer of the test image. FIG. 8 is a graph for illustrating the test image in the test mode. FIGS. 9(*a*) and 9(*b*) are graphs for illustrating the detected current in the test mode. FIG. 10 is a graph showing a relationship between a difference in detected current and the toner amount. FIG. 11 is a graph showing a relationship between the difference in detected current and the toner amount under several environment conditions.

As shown in FIG. 3, the control portion 10 includes a reading control portion 202, a control circuit (CPU) 203, a pattern indicating portion 204, an output control portion 206, a gradation correcting portion 207 and a transfer voltage/current detecting portion 208. The control portion 10 forms an exposure image data for the test image PG.

The control circuit 203 currents the output control portion 206 to set the image forming condition for providing a target image density of 1.6. The gradation correcting portion 207 sets the developing contrast Vcont for the maximum image density and then sets a proper two-valued modulation width (length of dot for two-value exposure) for each of half-tone gradation levels with respect to the image density. The reading control portion 202 reads the image by controlling the scanner 12.

As shown in FIG. 6 with reference to FIG. 2, the control portion 10 detects, when image density adjustment (the test mode) is started, the transfer current at the time of non-image formation assumed on the basis of the test image with the toner amount of 0 mg/cm$^2$ and set the transfer current as a current current (S1). The dark portion potential VD is set by detecting the surface potential of the photosensitive drum 1Y with the use of the potential sensor 7Y, and the transfer current is detected by the current detecting circuit 11 by applying the voltage VH, present in the range in which the transfer efficiency is lowered on the high voltage side, to the primary transfer roller 5Y without performing the exposure.

The control portion 10 provides instructions to form the test image PG with a maximum image width by the pattern indicating portion 204, thus causing the output control portion 206 to form the test image PG on the photosensitive drum 1Y. The control portion 10 applies, at the time when the test image PG passes through the primary transfer portion T1, the voltage VH equal to that during the measurement of the reference to the primary transfer roller 5Y, and detects the transfer current at that time by the current detecting circuit 11 (S2).

The control portion 10 judges whether or not a difference between the detected current and the reference current is less than 2 μA corresponding to the toner amount for the image density of 1.6 (S3). In the case where the difference is less than 2 μA ("YES" of S3), the developing contrast Vcont is increased by increasing the DC voltage Vdc and the dark portion potential VD by 5 V (S4).

The control portion 10 judges whether or not the difference between the detected current and the reference current is more than 2 μA corresponding to the toner amount for the image density of 1.6 (S5). In the case where the difference is more than 2 μA ("YES" of S5), the developing contrast Vcont is decreased by decreasing the DC voltage Vdc and the dark portion potential VD by 5 V (S6).

In the case where the difference between the detected current and the reference current is just equal to 2 μA ("NO" of S3 and "NO" of S5), the control portion 10 fixes the DC voltage Vdc and the dark portion potential VD at their present setting values and then completes the developing contrast adjustment for the maximum image density (S7).

Thereafter, the control portion forms a plurality of test images PG different in dot length for the two-value exposure in association with a plurality of levels of the image densities at the set developing contrast Vcont, and measures the toner amount for each test image PG. Then, the control portion 10 sets the dot length for the two-value exposure at each of the image density levels depending on a result of measurement of the toner amount at each of the image density levels.

As shown in FIG. 7 with reference to FIG. 2, on the photosensitive drum 1Y, the test image PG as the test image (solid image) having a uniform thickness with no area modulation is formed.

The test image PG passes through the primary transfer portion T1 at which the intermediary transfer belt 9 is sandwiched between the photosensitive drum 1Y and the primary transfer roller 5Y. At that time, a constant voltage is applied from the power source (bias applying means) D1 to the primary transfer roller 5Y and monitoring of the resultant primary transfer current is performed by the current detecting circuit 11. At the primary transfer portion T1. A length Lpg of the test image PG along the longitudinal direction of the primary transfer portion T1 is 304.8 mm which is a maximum image width in the image forming portion PY.

As shown in FIG. 8, a change in transfer current detected by the current detecting circuit 11 was measured by changing the length Lpg of the test image PG. As a result, when an image width ratio of the test image length to the maximum image width of 304.8 mm is 100%, the current passing outside the test image PG is minimum, so that measurement accuracy of the transfer current is highest.

However, when the image width ratio is 50%, the transfer current is substantially saturated and therefore it is possible to estimate the toner amount of the test image PG passing through the primary transfer portion T1 with sufficient accuracy by forming the test image PG so as to have the length which is 50% or more of the maximum image width.

The formation of the test image PG for the image density adjustment can be automatically effected at an interval (sheet interval) between an output image and a subsequent output image in continuous image formation or during post-rotation after completion of an image output job. Further, the test image formation can also be effected in a single mode by providing instructions through the operating panel 13 during non-image formation.

In the case of the single mode, the above-described control along the flow chart is continuously effected until the difference between the detected current and the reference current reaches just 2 μA. In the case where the image density adjustment is performed at the image interval, a process in which the test image PG is formed at an image interval and the DC voltage Vdc and the dark portion potential VD are obtained and then the test image PG is formed at a subsequent image interval based on the obtained DC voltage Vdc and the obtained dark portion potential VD and thereafter the DC voltage Vdc and the dark portion potential VD are obtained again is repeated. Then, at the time when the difference between the detected current and the reference current reaches just 2 μA, the adjustment of the developing contrast Vcont for the maximum image density is completed.

As shown in FIG. 9(*a*), depending on the primary transfer contrast, the current passing through the primary transfer portion T1 is changed. Each of lines indicated in FIG. 9(*a*) represents the transfer current when the toner amount M/S ($mg/cm^2$) of the test image PG is changed. The rotational speed of the photosensitive drum 1Y is 140 mm/sec and an environmental condition is a normal temperature and normal humidity (NN: 23° C. and 50% RH) environment.

The primary transfer contrast when the reference current is obtained is the potential difference between the dark portion potential VD of the photosensitive drum 1Y and the DC voltage applied to the primary transfer roller 5Y since a white background image is formed. The primary transfer contrast when the transfer current of the test image PG is obtained in the potential difference between the light portion potential VL of the photosensitive drum 1Y and the DC voltage applied to the primary transfer roller 5Y since the test image is formed in a uniform thickness.

As shown in FIG. 9(*b*), depending on the primary transfer contrast, the transfer efficiency of the toner image at the primary transfer portion T1 is changed. Here, for the sake of simplicity, the voltage in the proper range B is applied to the primary transfer roller 5Y, so that the toner image is primary-transferred from the photosensitive drum 1Y onto the intermediary transfer belt 9 with the transfer efficiency of 100%.

In the proper range B in which the primary transfer contrast ranges from 200 V to 600 V, the transfer efficiency of the toner image is 100%. On the high voltage side C where the primary transfer contrast exceeds 600 V, the transfer efficiency is gradually decreased with an increasing primary transfer contrast.

As shown in FIG. 9(*b*), the transfer efficiency is saturated in the proper range B in which the primary transfer contrast used during the image formation is 200 V to 600 V. In the area on the high voltage side C where the transfer efficiency is lower than that in the proper range B with the increasing primary transfer contrast, as shown in FIG. 9(*a*), the slope of the toner amount of 0 $mg/cm^2$ and those of the toner amounts of 3 $mg/cm^2$, 6 $mg/cm^2$ and 9 $mg/cm^2$ are close to each other. That is, by obtaining the difference between the transfer current when the toner amount is positive and the transfer current, as the reference current, when the toner amount is 0 $mg/cm^2$, it is possible to eliminate a factor other than the difference in toner amount.

For this reason, even in the case where the cumulative number of sheets subjected to the image formation is increased and a resistance value of the primary transfer roller 5Y is increased, the difference is equal when the toner amount is equal, so that the same difference, i.e., 2 μA for the target image density of 1.6 can be used in the image density adjustment.

In this embodiment, the transfer current during the passing of the test image PG through the primary transfer portion T1 is detected by using the primary transfer contrast of 1000 V in the area on the high voltage side C. At the primary transfer contrast fixed at 1000 V, the reference current during the non-image formation in which the toner amount M/S was 0 $mg/cm^2$ was measured. Further, three test images PG were formed in different toner amounts M/S of 0.3 $mg/cm^2$, 0.6 $mg/cm^2$ and 0.9 $mg/cm^2$ and their transfer currents were measured. Then, a relationship between the toner amount of the test image and the difference obtained by subtracting the reference current during the non-image formation from the transfer current of the test image PG was studied.

As a result, as shown in FIG. 10, with an increasing toner amount of the test image PG, the difference obtained by subtracting the reference current during the non-image formation from the transfer current of the test image PG becomes larger. The point is larger with the increasing toner amount, and the case where the toner amount is 0.3 $mg/cm^2$ or less, there is substantially no difference between the transfer current and the toner current during the non-image formation.

That is, in the case where the transfer current is used for the image density control, when the toner amount is on a high density side where the toner amount is 0.4 mg/cm$^2$ or more, the toner amount can be measured with accuracy higher than that of the image density sensor 17.

Here, the maximum image density set for the image forming portion PY is 1.6 and the toner amount at this time is 0.6 mg/cm$^2$. As shown in FIG. 10, when the toner amount is 0.6 mg/cm$^2$, the difference between the reference current and the transfer current is 2 μA. Therefore, a target current difference with respect to the maximum image density is 2 μA.

As shown in FIG. 11, when the temperature and humidity environment is changed, the relationship between the toner amount and the transfer current difference is changed. In the figure, NL represents a normal temperature and low humidity (23° C., 5% RH) environment, NN represents a normal temperature and normal humidity (23° C., 50% RH) environment, and HH represents a high temperature and high humidity (30° C., 80% RH) environment. For this reason, the difference corresponding to the target toner amount of 0.6 mg/cm$^2$ used in the image density control is changed to 1 μA in the NL environment, 2 μA in the NN environment, and 2.8 μA in the HH environment.

The change in transfer current with respect to the toner amount is larger in the order of NL, NN and HH, so that a measurement resolution of the toner amount is also higher in the order of NL, NN and HH and therefore the image density control can be effected with high accuracy. In a lower humidity environment, the control is made with higher accuracy but in a higher humidity environment, the accuracy is lower. This difference is largely depend on a toner charge amount Q/M (μC/g). Specifically, the toner charge amount Q/M (μC/g) was −35 μC/g in NL, −22.4 μC/g in NN and −15 μC/g in HH.

However, the output of the image density sensor 17 is saturated at the toner amount of 0.5 mg/cm$^2$ as shown in FIG. 7, whereas there is a solution with respect to the toner amount-point characteristic in the HH environment as shown in FIG. 11 although the degree of the solution is gentle.

For this reason, in the case of the HH (high temperature and high humidity) environment, the accuracy comparable to that in a low temperature and low humidity environment is ensured by forming the test image PG and increasing the number of measurement of the transfer current.

The change in density of the maximum density image in the case where the image density control in this embodiment was effected was measured and was compared with that in the case of the conventional control effected by measuring the change in density of the half-tone test image by using the image density sensor 17.

TABLE 1

| | Image density change |
|---|---|
| Conventional | 1.5 to 1.6 |
| EMB. 1 | 1.55 to 1.6 |

As shown in Table 1, the density change of an output product is large, i.e., 1.5 to 1.6 in the conventional control, whereas the density change of the output product is small, i.e., 1.55 to 1.6 in the control in Embodiment 1. Thus, the control in Embodiment 1 is effective when compared with the conventional control.

In the image density control in Embodiment 1, the test mode is executed, so that the voltage higher than that during the normal image formation is applied to the primary transfer roller 5Y when the toner image passes through the primary transfer portion T1 and then the transfer current is detected in the transfer efficiency lowering area. As a result, the toner amount of the high density toner image for which the toner amount was not measurable in the image density sensor 17 can be measured with high accuracy, so that the developing contrast of the high density toner image can be adjusted directly.

As shown in FIG. 4, the test image for providing the toner amount less than a predetermined value (<0.4 mg/cm$^2$) is subjected to measurement of the toner amount by using the image density sensor 17 but the test image for providing the toner amount not less than the predetermined value (≧0.4 mg/cm$^2$) is subjected to the measurement of the toner amount on the basis of the transfer current detected in the test mode. For this reason, an error in toner amount control in the high density area is decreased, so that the image density on the high density side, particularly the maximum image density is controlled with high accuracy and therefore it is possible to alleviate a change in hue of the output image.

Further, the length of the toner image during the detection of the transfer current is ½ or more of the maximum image width, so that it is possible to maintain a difference between the transfer current in the case where the toner image is formed and the transfer current in the case where the toner image is not formed. Thus, the toner image is in a state in which the toner image is usable for the image density control on the high density side.

Incidentally, in this embodiment, the transfer portion (primary transfer portion T1) in the tandem type intermediary transfer method in which the intermediary transfer member (intermediary transfer belt 9) is sandwiched between the image conveying member (photosensitive drum 1Y) and the transfer means (primary transfer roller 5Y) is described.

However, in this Embodiment 1, the image density control can be effected not only at the primary transfer portion T1 but also at the secondary transfer portion T2 created between the image conveying member (intermediary transfer belt 9) and the transfer means (the secondary transfer roller 23), so that the toner amount of the toner image can be measured. Further, the image forming apparatus is not limited to that of the tandem type but may also be a single (one) drum type full-color printer (FIG. 17) including a plurality of developing devices. Also in this case, the image density control can be effected at the primary transfer portion (contact portion between the photosensitive drum 1 and the intermediary transfer belt 9) and at the secondary transfer portion T2. The present invention is applicable to not only the full-color printer but also a monochromatic printer. Further, the transfer method is not limited to the intermediary transfer method but may also be a recording material transfer method or a direct transfer method.

<Embodiment 2>

Figure 12:
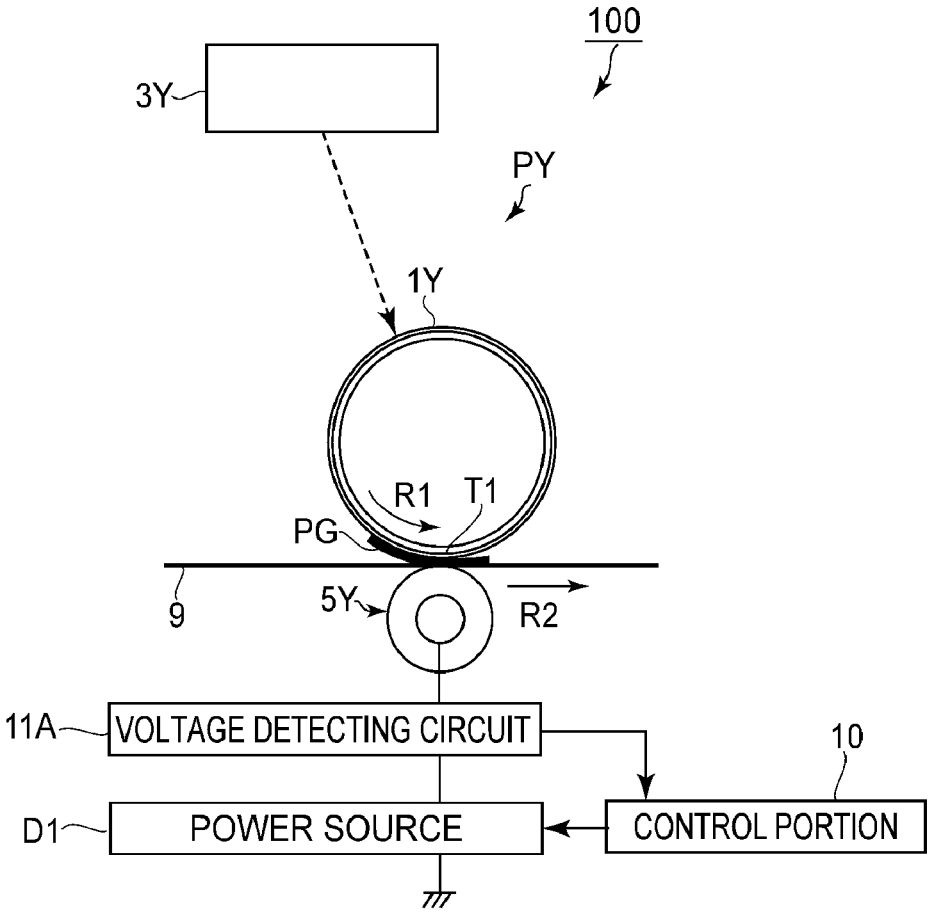
FIG. 12 is an illustration of a structure of the image forming apparatus in Embodiment 2.
Figure 13:
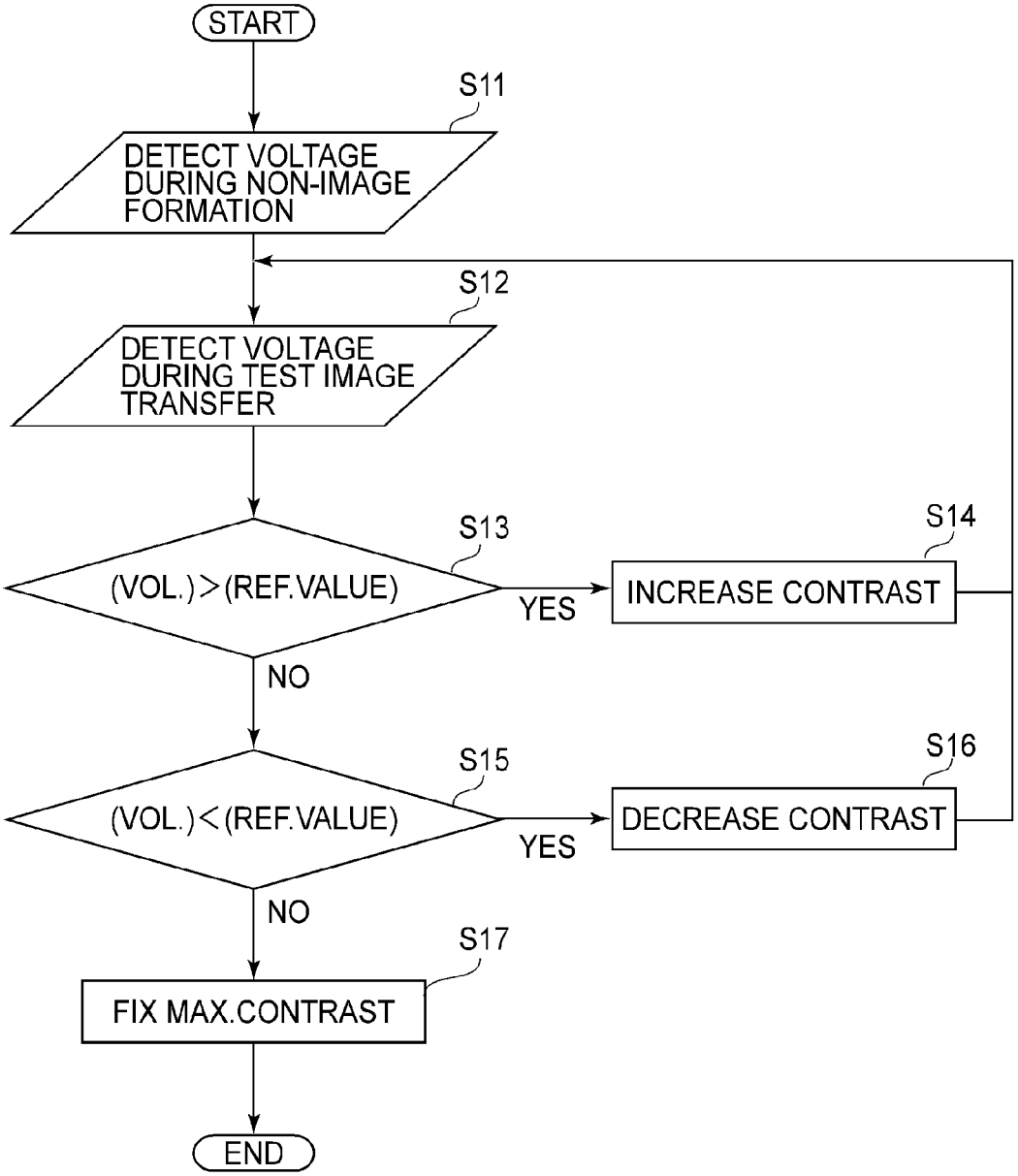
FIG. 13 is a flow chart for illustrating the image density adjustment in Embodiment 2.
Figure 14:
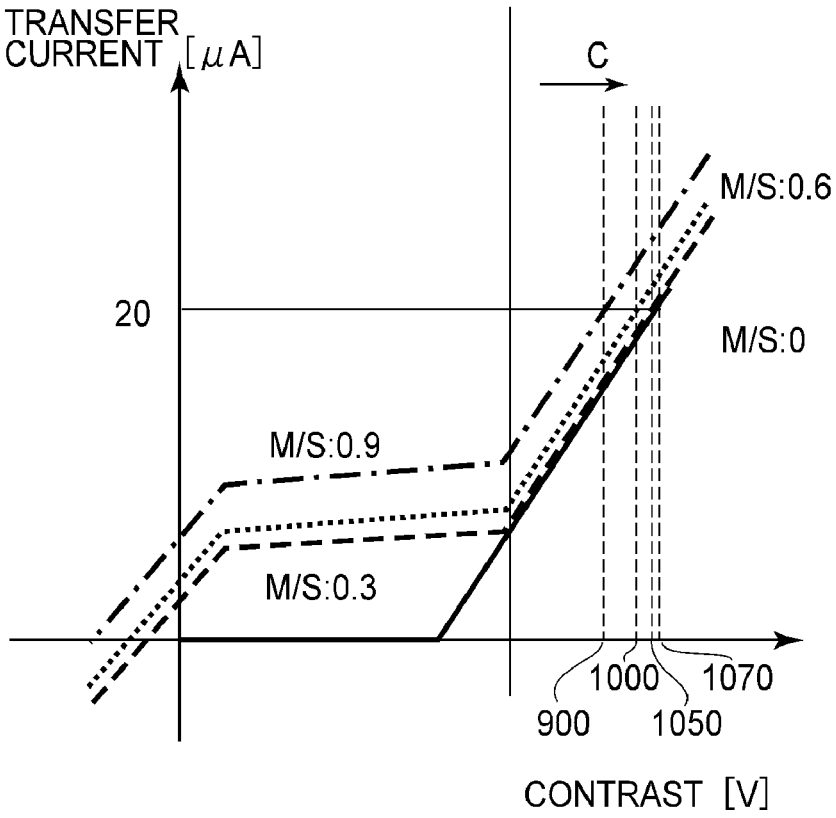
FIG. 14 is a graph for illustrating a detected voltage in the test mode.
Figure 15:
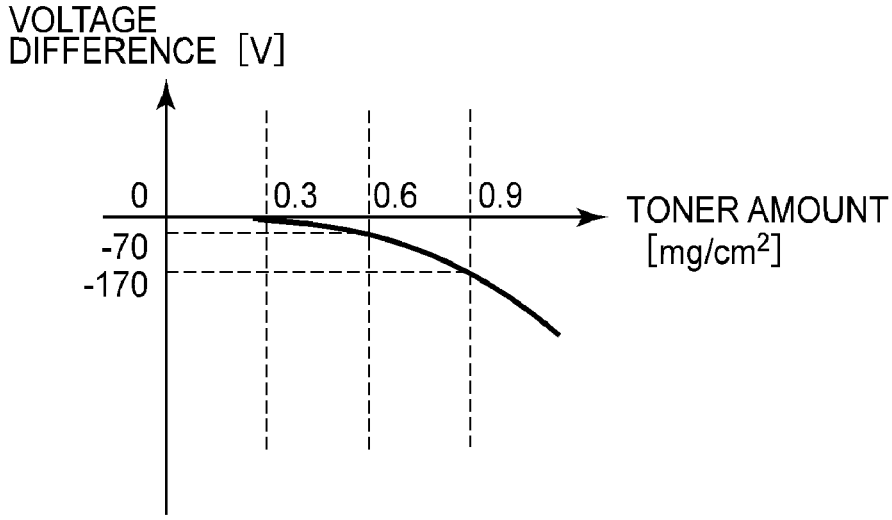
FIG. 15 is a graph showing a relationship between a difference in detected voltage and the toner amount.

FIG. 12 is an illustration of a structure of the image forming apparatus in this embodiment. FIG. 13 is a flow chart for illustrating the image density adjustment in this embodiment. FIG. 14 is a graph for illustrating a detected voltage in the test mode. FIG. 15 is a graph showing a relationship between a difference in detected voltage and the toner amount.

In the test mode in Embodiment 1, the transfer current was detected by applying the constant voltage to the primary transfer portion T1. On the other hand, in the test mode in this embodiment, the transfer voltage is detected by applying a constant current to the primary transfer portion T1.

As shown in FIG. 12, a voltage detecting means 11A detects the voltage to be applied to the transfer portion T1 to which the current has been applied. The control portion 10 transfers the toner image onto the image receiving member 9 by applying to the transfer portion T1 a current on a high current side where the transfer efficiency of the toner image is lowered. Then, information corresponding to the toner amount is obtained on the basis of the voltage detected by the voltage detecting means 11A.

That is, in this embodiment, the current detecting circuit 11 in FIG. 2 is replaced with the voltage detecting means (circuit) 11A and the power source D1 is replaced with a constant current power source D1 by which the output voltage is variably controlled so as to provide a set transfer current. Further, the exposure device 3Y sets the half-tone gradation level not by the area modulation but by changing the exposure intensity depending on the density gradation level of the image data. For this reason, different from Embodiment 1, the developing contrast is settable with respect to not only the toner amount of 0.6 mg/cm$^2$ for the maximum image density but also the toner amounts of 0.1 mg/cm$^2$ to 0.5 mg/cm$^2$ for intermediate image densities.

The control portion 10 outputs, from the power source D1, the voltage set so that the voltage is higher than that during the image formation and the constant current is set at 20 μA, and applies the voltage to the primary transfer roller 5Y. Then, the voltage applied to the primary transfer roller 5Y is measured by the voltage detecting circuit 11A.

As shown in FIG. 13 with reference to FIG. 12, the control portion 10 detects, when the image density adjustment (test mode) is started, the output voltage during the non-image formation in which the constant current control at 20 μA is effected and determines the detected output voltage as a reference (S1). Then, the control portion 10 forms the test images PG on the photosensitive drum 1Y. Instructions to form the test images PG which have the maximum image width but are different in image density are provided by the pattern indicating portion 204, shown in FIG. 3, so that the output control portion 206 forms the test images PG on the photosensitive drum 1Y. In this embodiment, six test images PG different in exposure intensity for providing six levels from 0.1 mg/cm$^2$ to 0.6 mg/cm$^2$ are successively formed.

The control portion 10 detects, through the voltage detecting circuit 11A, the voltage applied to the primary transfer roller 5Y by the constant current control when each of the test images PG different in developing contrast Vcont at six levels passes through the primary transfer portion T1 (S12).

The control portion 10 judges whether or not a difference between the detected voltage and the reference voltage is more than a reference difference value corresponding to each of the levels of the toner amounts from 0.1 mg/cm$^2$ to 0.6 mg/cm$^2$ (S13). In the case where the difference is more than an associated reference difference value ("YES" of S13), the developing contrast Vcont is increased by increasing the DC voltage Vdc and the dark portion potential VD by 5 V (S14).

The control portion 10 judges whether or not the difference between the detected current and the reference current is less than the associated reference difference value (S15). In the case where the difference is less than the associated reference difference value ("YES" of S15), the developing contrast Vcont is decreased by decreasing the DC voltage Vdc and the dark portion potential VD by 5 V (S16).

In the case where the difference between the detected current and the reference current is equal to the associated reference difference value ("NO" of S13 and "NO" of S15), the control portion 10 fixes the DC voltage Vdc and the dark portion potential VD, which are associated with each of the levels of the image density, at their present setting values and then completes the image density adjustment (S17).

Here, the reference difference value corresponding to each of the respective levels of the toner amounts 0.1 mg/cm$^2$ to 0.6 mg/cm$^2$ was obtained in the following manner. The value of the constant current was set at 20 μA on the high current side where the transfer current was lowered and then the voltage applied to the primary transfer roller 5Y when each of the test images TG having the toner amounts of 0.3 mg/cm$^2$, 0.6 mg/cm$^2$ and 0.9 mg/cm$^2$ passed through the primary transfer portion T1 was measured.

As shown in FIG. 14, the voltage applied to the primary transfer roller 5Y when the test image TG passes through the primary transfer portion T1 at which the applied voltage is constant current-controlled is changed depending on the toner amount. The difference was obtained by subtracting the reference voltage (1070 V), during the non-image formation, corresponding to the toner amount of 0 mg/cm$^2$ from the voltage measured with each of the toner amounts (M/S) shown in FIG. 14. A relationship between the difference and the toner amounts is shown in FIG. 15.

As shown in FIG. 15, with respect to the difference between the measured voltage and the reference voltage, there is substantially no difference when the toner amount is 0.3 mg/cm$^2$ or less but then the difference becomes larger with an increasing toner amount. For this reason, in the case where the image density control is effected by using the relationship between the toner amount and the difference between the measured voltage and the reference voltage, the toner image is on the high density side where the toner amount is 0.4 mg/cm$^2$ or more is directed measured, so that the developing contrast can be controlled.

The maximum image density set for the image forming portion PY is 1.6 and the toner amount at this time is 0.6 mg/cm$^2$. As shown in FIG. 10, when the toner amount is 0.6 mg/cm$^2$, a target voltage (difference) corresponding to the maximum image density of 1.6 is −70 V. Further, the target voltages (differences) corresponding to the toner amounts of 0.3 mg/cm$^2$ and 0.9 mg/cm$^2$ are −20 V and −170 V, respectively.

The change in density of the maximum density image in the case where the image density control in this embodiment was effected was measured and was compared with that in the case of the conventional control effected by measuring the change in density of the half-tone test image by using the image density sensor 17.

TABLE 2

| | Image density change |
|---|---|
| Conventional | 1.5 to 1.6 |
| EMB. 2 | 1.60 to 1.65 |

As shown in Table 2, the density change of an output product is large, i.e., 1.5 to 1.6 in the conventional control, whereas the density change of the output product is small, i.e., 1.60 to 1.65 in the control in Embodiment 2. Thus, the control in Embodiment 2 is effective when compared with the conventional control.

In the image density control in Embodiment 2, the transfer current when the plurality of test images different in image density pass through the primary transfer portion T1 is detected, so that the relationship between the toner density and the transfer current is determined in the entire range from the maximum image density to the minimum image density. By interpolating or extrapolating each of the resultant relationships, the image densities from the maximum image density to the minimum image density are reproduced with accuracy and thus natural and high-quality output images at half-tone gradation levels are obtained.

Incidentally, in this Embodiment 2, the image density control can be effected not only at the primary transfer portion T1 but also at the secondary transfer portion T2, so that the toner amount of the toner image can be measured. Similarly as in Embodiment 1, the image forming apparatus is not limited to that of the tandem type but may also be the single (one) drum type full-color printer (FIG. 17) including a plurality of developing devices. Also in this case, the image density control can be effected at the primary transfer portion (contact portion between the photosensitive drum 1 and the intermediary transfer belt 9) and at the secondary transfer portion T2. The present invention is applicable to not only the full-color printer but also a monochromatic printer. Further, the transfer method is not limited to the intermediary transfer method but may also be a recording material transfer method or a direct transfer method.

<Embodiment 3>

Figure 16:
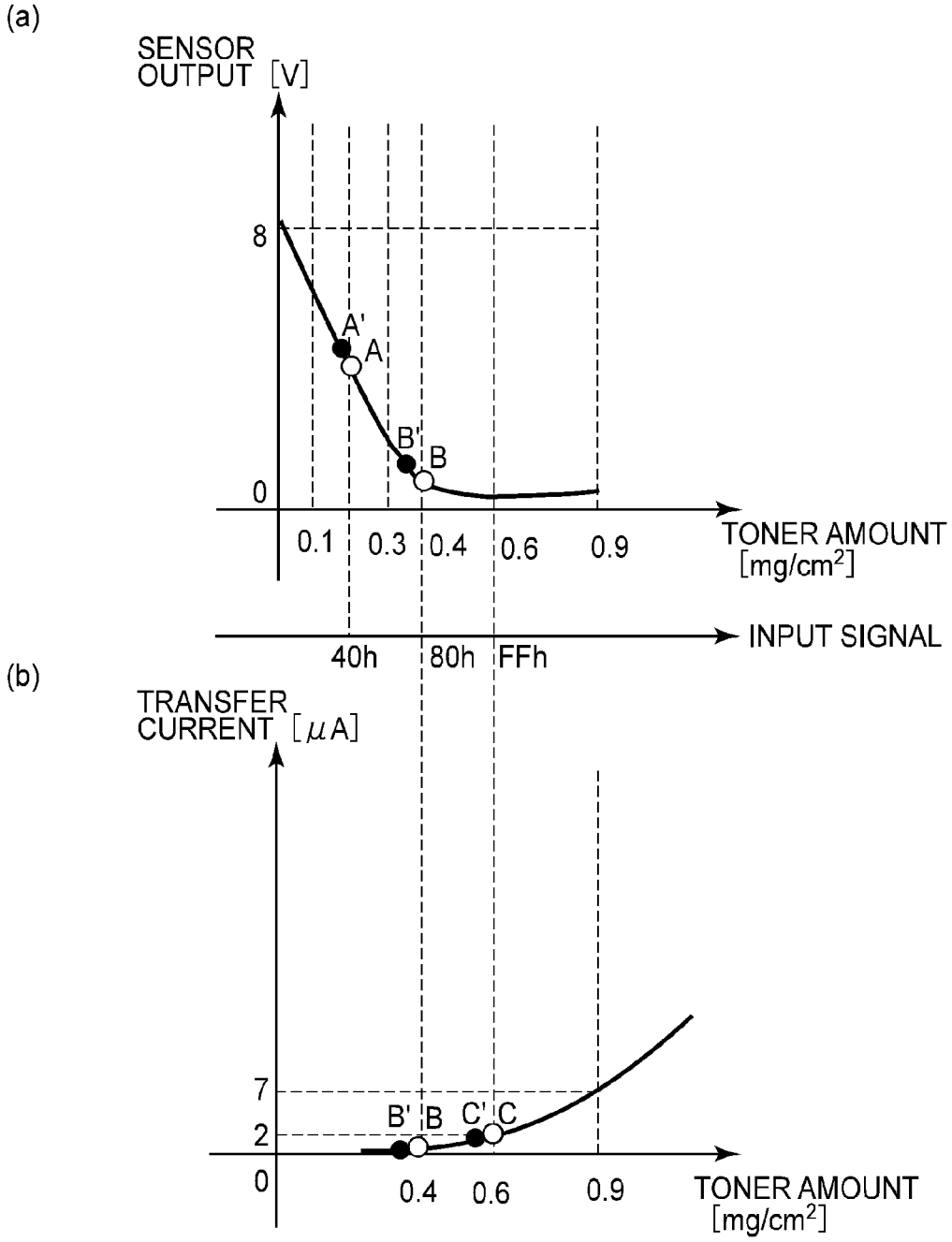
FIGS. 16(*a*) and 16(*b*) are graphs for illustrating image density control in Embodiment 3.

FIGS. 16(*a*) and 16(*b*) are graphs for illustrating the image density control in Embodiment 3.

In this embodiment, by complementarily using the image density sensor 17 as the optical sensor and the current voltage data at the primary transfer portion, the toner amounts are measured with accuracy in the entire range from the maximum image density to the minimum image density.

As shown in FIG. 2, the control portion 10 forms the plurality of test images at the same developing contrast. One of the plurality of test images is transferred onto the image receiving member 9 by using the transfer bias for providing the transfer efficiency of 90% or more and is detected by the optical sensor 17. Other test images are transferred onto the image receiving member 9 by using the transfer biases for providing the transfer efficiencies of less than 90%. At this time, the test image detected by the optical sensor has a normal color patch size. However, the test images detected by the detecting means 11 are, as shown in FIG. 7, different in length with respect to the longitudinal direction of the transfer portion from the color patch size and have the lengths which is ½ or more of the length with respect to the longitudinal direction of the transfer portion.

As shown in FIG. 16(*a*), the image density sensor 17 is used in the image density control on the low density side where the toner amount is 0.4 mg/cm$^2$ or less. As shown in FIG. 16(*a*), during the actuation of the image forming apparatus 100, the density detection by the image density sensor 17 is performed in the range from the toner amount of 0.1 mg/cm$^2$ to the toner amount of 0.4 mg/cm$^2$ with an increment of 0.05 mg/cm$^2$, so that a table indicating the relationship between the output of the image density sensor 17 and the toner amount is prepared.

In an initial stage, in the case where the input signal was 40/FF in terms of the hexadecimal notation, the toner amount was 0.2 mg/cm$^2$ (point A) and in the case where the input signal was 80/FF, the toner amount was 0.4 mg/cm$^2$ (point B). Thereafter, assuming that the cumulative number of sheets subjected to the image formation reaches 1,000,000 sheets and the toner amount is lowered thereby to change the point A to a point A' and to change the point B to a point B', the original toner amounts are the point A and the point B and therefore the image density control on the low density side is effected by increasing the dot exposure intensity so as to shift the point A' to the point A and shift the point B' to the point B. For example, in the case where the target test image PG having the toner amount of 0.2 mg/cm$^2$ is formed on the photosensitive drum 1Y and transferred onto the intermediary transfer belt 9 and then is read by the image density sensor 17, the output at the point A' is obtained. In this case, the control portion 10 increases the exposure intensity of the dot so that the resultant output coincides with the output at the point A.

As shown in FIG. 16(*b*), the image density sensor 17 is used in the image density control on the high density side where the toner amount is 0.4 mg/cm$^2$ or more. As shown in FIG. 16(*b*), during the actuation of the image forming apparatus 100, the image density control in Embodiment 2 is performed in the range from the toner amount of 0.4 mg/cm$^2$ to the toner amount of 0.9 mg/cm$^2$ with an increment of 0.05 mg/cm$^2$, so that a table indicating the toner amount and the difference between the reference current and the measured current is prepared.

In an initial stage, in the case where the input signal of the exposure device was 80/FF in terms of the hexadecimal notation, the toner amount was 0.4 mg/cm$^2$ (point B) and in the case where the input signal was FF/FF, the toner amount was 0.6 mg/cm$^2$ (point C). Thereafter, assuming that the cumulative number of sheets subjected to the image formation reaches 1,000,000 sheets and the toner amount is lowered thereby to change the point B to a point B' and to change the point C to a point C', the original toner amounts are the point B and the point C and therefore the image density control on the high density side is effected by increasing the dot exposure intensity so as to shift the point B' to the point B and shift the point C' to the point C.

Here, with respect to the point B (point B'), the detection is made by using both of the image density sensor 17 and the transfer current. Then, by giving high priority to one having high sensitivity, it becomes possible to enhance the accuracy of the image density control in the neighborhood of the point B. In this embodiment, by giving high priority to the image density sensor 17 having the high sensitivity at the point B, the difference between the primary transfer current and the reference current under the image forming condition after the toner amount was corrected by the image density sensor 17 was taken as the value at the point B.

In the image density control in this embodiment, at least one of the measured points in the low density side image density control and the measured points in the high density side image density control is taken as the toner amount or the input signal, so that it is possible to effect the image density control on the low density side and the image density control on the high density side seamlessly.

Incidentally, in this Embodiment 3, the image density control can be effected not only at the primary transfer portion T1 but also at the secondary transfer portion T2, so that the measurement result of the toner amount of the toner image can be evaluated. Similarly as in Embodiment 1, the image forming apparatus is not limited to that of the tandem type but may also be the single (one) drum type full-color printer (FIG. 17) including a plurality of developing devices. Also in this case, the image density control can be effected at the primary transfer portion (contact portion between the photosensitive drum 1 and the intermediary transfer belt 9) and at the secondary transfer portion T2. The present invention is applicable to not only the full-color printer but also a monochromatic printer. Further, the transfer method is not limited to the intermediary transfer method but may also be a recording material transfer method or a direct transfer method.

<Embodiment 4>

Figure 17:
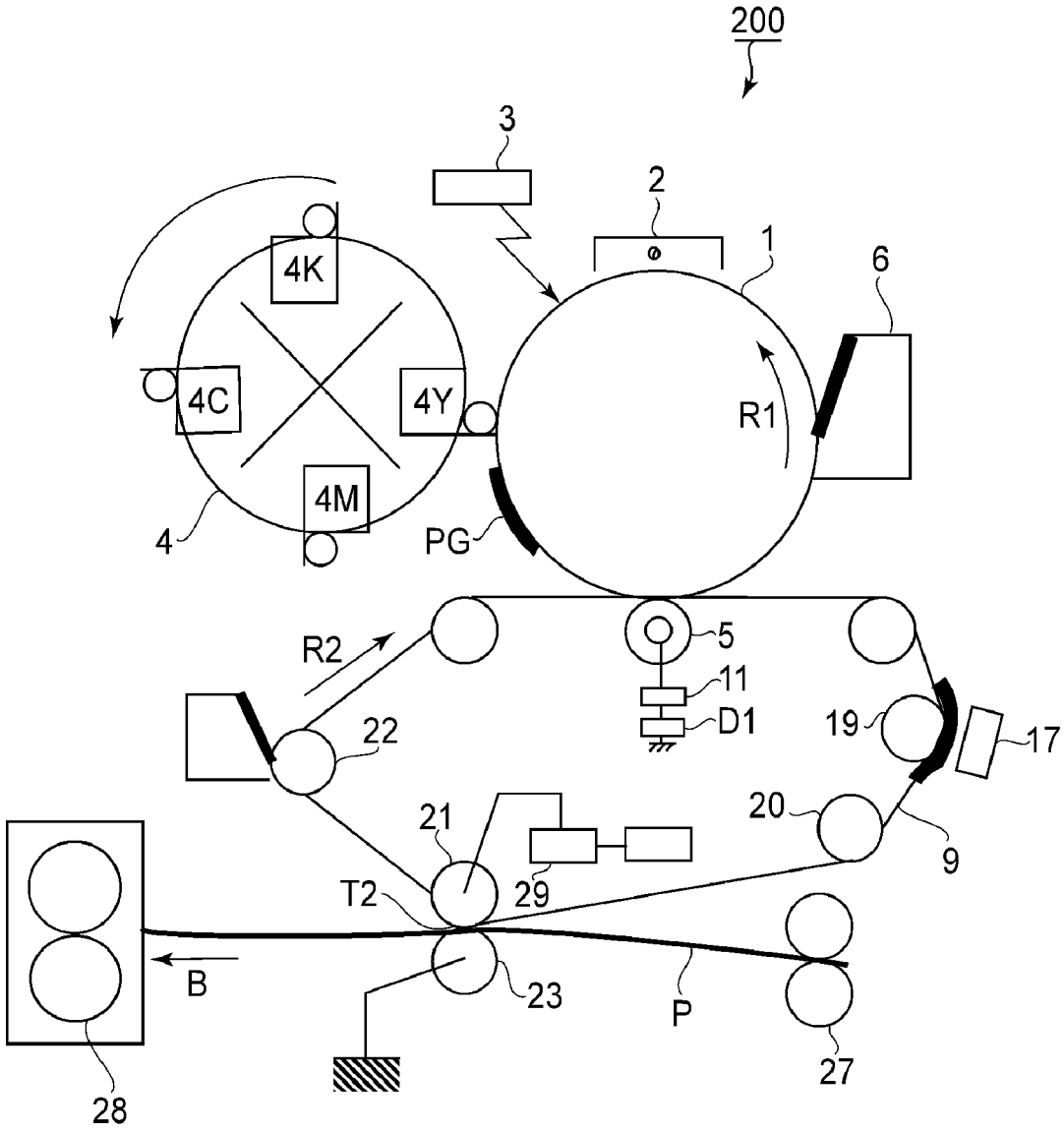
FIG. 17 is an illustration of a structure of the image forming apparatus in Embodiment 4.

FIG. 17 is an illustration of the structure of the image forming apparatus in Embodiment 4.

In Embodiments 1 to 3, the embodiments using the tandem type full-color printer shown in FIG. 1 are described but in this embodiment, the single drum type full-color printer as shown in FIG. 17 is used.

As shown in FIG. 17, an image forming apparatus 200 includes, around the photosensitive drum 1, the charging device 2, the exposure device 3, a rotary developing device 4, the primary transfer roller 5, and the cleaning device 6. The intermediary transfer belt 9 is extended around and supported by the tension roller 22, the driving roller 20 and the opposite roller 21.

The rotary developing device 4 is capable of positioning each of respective developing portions 4Y for yellow, 4M for magenta, 4C for cyan and 4K for black at the developing position of the photosensitive drum 1 by rotation. In FIG. 17, other constitutional members corresponding to those of the image forming apparatus 100 in Embodiment 1 shown in FIG. 1 are represented by the same reference numerals or symbols as those indicated in FIG. 1, thus being omitted from redundant description.

In the image forming apparatus 200, first, the developing portion 4Y is positioned at the developing position for the photosensitive drum 1 and the yellow toner image is formed on the photosensitive drum 1 and then is immediately primary-transferred onto the intermediary transfer belt 9. Next, at the developing position for the photosensitive drum 1, the developing portion 4M is positioned and a magenta toner image is formed and then is superposedly primary-transferred onto the yellow toner image on the intermediary transfer belt 9. Successively, the developing portions 4C and 4K are positioned at the developing position for the photosensitive drum 1 and the cyan toner image and the black toner image are formed on the photosensitive drum 1 and then are primary-transferred onto the intermediary transfer belt 9.

The four color toner images primary-transferred onto the intermediary transfer belt 9 are conveyed to the secondary transfer portion T2 and are collectively secondary-transferred onto the recording material P. The recording material P on which the four color toner images are secondary-transferred is subjected to the heat-pressing in the fixing device 28, so that the toner images are fixed on the recording material P. Thereafter, the recording material P is discharged to the outside of the image forming apparatus 200.

Also in the image forming apparatus 200, each of the respective control operations in FIGS. 1 to 3 is effected to achieve similar effects to those in Embodiments 1 to 3.

In the image forming apparatus of the present invention, in the test mode, the current at the time when the test image is transferred from the image conveying member onto the image receiving member by applying the test bias larger in absolute value than the transfer bias. At this time, the transfer current corresponding to the toner amount is measured and the current passing through the transfer portion is larger as the toner amount is larger. However, compared with the case where the transfer bias is applied, it is possible to detect the current which accurately reflects the toner amount of the test image (with high S/N ratio).

As a result, the toner amount can be measured with high resolution even with respect to the toner image having the image density close to the maximum image density at which the sensitivity is lost in the optical sensor. Therefore, without adding a particular measuring equipment, it is possible to estimate the image density with necessary and sufficient accuracy with respect to the high-density test image for which the detection resolution cannot be obtained by the optical sensor.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 145308/2009 filed Jun. 18, 2009, which is hereby incorporated by reference.

What is claimed is:

1. An image forming apparatus comprising:

image forming means for forming a toner image on an image conveying member on the basis of an input image signal;

transfer means for transferring the toner image from the image conveying member onto an image receiving member;

bias applying means for applying a transfer bias to said transfer means when the toner image is transferred from the image conveying member onto the image receiving member;

executing means for executing a test mode in which a test image is formed on the image conveying member and is then transferred onto the image receiving member;

detecting means for detecting a current passing through said transfer means in the test mode;

control means for controlling an image forming condition of said image forming means on the basis of an output of said detecting means; and setting means for setting a test bias to be applied from said bias applying means at a value larger than the transfer bias in terms of an absolute value, wherein said bias applying means applies the transfer bias so that a transfer efficiency from the image conveying member onto the image receiving member is 90% or more and applies the test bias so that the transfer efficiency from the image conveying member onto the image receiving member is less than 90%.

2. An apparatus according to claim 1, further comprising an optical sensor for detecting reflected light depending on a toner amount per unit area of the test image by irradiating the test image transferred on the image receiving member with predetermined detection light, wherein said bias applying means applies the transfer bias so that the transfer efficiency is 90% or more for the test image having the toner amount less than a predetermined value and applies the transfer bias so that the transfer efficiency is less than 90% for the test image having the toner amount not less than the predetermined value.

3. An apparatus according to claim 2, wherein the test image for which the transfer bias is applied so that the transfer efficiency is 90% or more has a length, with respect to a longitudinal direction of a transfer portion, shorter than that of the test image for which the transfer bias is applied so that the transfer efficiency is less than 90%.

4. An image forming apparatus comprising:

image forming means for forming a toner image on an image conveying member;

transfer means for transferring the toner image from the image conveying member onto an image receiving member;

bias applying means for applying a transfer bias to said transfer means when the toner image is transferred from the image conveying member onto the image receiving member;

detecting means for detecting a current passing through said transfer means when a test image formed on the image conveying member is transferred onto said transfer means by applying a test bias larger than the transfer bias;

control means for controlling an image forming condition of said image forming means on the basis of an output of said detecting means; and setting means for setting the test bias to be applied from said bias applying means at a value larger than the transfer bias in terms of an absolute value, wherein said bias applying means applies the transfer bias so that a transfer efficiency of the toner image from the image conveying member onto the image receiving member is 90% or more and applies the test bias so that the transfer efficiency of the test image from the image conveying member onto the image receiving member is less than 90%.

5. An image forming apparatus comprising:

image forming means for forming a toner image on an image conveying member on the basis of an inputted image signal;

transfer means for transferring the toner image from the image conveying member onto an image receiving member at a transfer portion;

bias applying means for applying a transfer bias to said transfer means when the toner image is transferred from the image conveying member onto the image receiving member on the basis of the image signal;

executing means for executing an operation in plurality of first test modes, in each of which the image conveying member on which a test pattern is formed with a solid toner image in a predetermined toner amount over the entire test pattern with respect to a widthwise direction perpendicular to a conveyance direction of the image conveying member, is passed through the transfer portion while applying a test bias from said bias applying means to said transfer means and an operation in a second test mode in which the image conveying member, on which a test pattern is formed with no toner image over the entire test pattern with respect to the widthwise direction, is passed through the transfer portion while applying a test bias from said bias applying means to said transfer means;

detecting means for detecting a current passing through said transfer means during execution of the operation in each of the first test modes and a current passing through said transfer means during execution of the operation in the second test mode, wherein the currents detected by said detecting means are those when an electric field not less than a discharge start electric field is applied between said transfer means and the image conveying member; and control means for controlling said image forming means on the basis of detection results of said detecting means so that the toner amount of the solid toner image formed on the image conveying member is changed, wherein the detection results are a current detection result in each of the first test modes in which the predetermined toner amounts of the solid toner images are different from each other and a current detection result in the second test mode.

6. An apparatus according to claim 5, wherein a surface potential of the image conveying member during the execution of the operation in the first test modes and a surface potential of the image conveying member during the execution of the operation in the second test mode are the same, and wherein the test bias in the operation in the first test modes and the test bias in the operation in the second test mode are the same.

7. An apparatus according to claim 5, wherein said image forming means comprises charging means for electrically charging the image conveying member and exposure means for exposing to light the image conveying member after being charged by said charging means, wherein a surface potential of the image conveying member during the execution of the operation in the first test modes is a surface potential after the exposure by said exposure means, and a surface potential of the image conveying member during the execution of the operation in the second test mode is a surface potential after the charging by said charging means, and wherein the test bias in the operation in the first test modes and the test bias in the operation in the second test mode are different from each other.

8. An apparatus according to claim 5, wherein said image forming means comprises charging means for electrically charging the image conveying member and exposure means for exposing to light the image conveying member after being charged by said charging means, wherein a surface potential of the image conveying member during the execution of the operation in the first test modes is a surface potential after the charging by said charging means, and a surface potential of the image conveying member during the execution of the operation in the second test mode is a surface potential after the exposure by said exposure means, and wherein the test bias in the operation in the first test modes and the test bias in the operation in the second test mode are different from each other.

9. An image forming apparatus comprising:

image forming means for forming a toner image on an image conveying member on the basis of an inputted image signal;

transfer means for transferring the toner image from the image conveying member onto an image receiving member at a transfer portion;

bias applying means for applying a transfer bias to said transfer means when the toner image is transferred from the image conveying member onto the image receiving member on the basis of the image signal;

executing means for executing an operation in a plurality of first test modes, in each of which the image conveying member on which a test pattern is formed with a solid toner image in a predetermined toner amount over the entire test pattern with respect to a widthwise direction perpendicular to a conveyance direction of the image conveying member, is passed through the transfer portion while passing a test current through said transfer means by said bias applying means and an operation in a second test mode in which the image conveying member, on which a test pattern is formed with no toner image over the entire test pattern with respect to the widthwise direction, is passed through the transfer portion while passing a test current through said transfer means by said bias applying means;

detecting means for detecting a voltage applied to said transfer means during execution of the operation in each of the first test modes and a voltage applied to said transfer means during execution of the operation in the second test mode, wherein the voltages detected by said detecting means are those when an electric field not less than a discharge start electric field is applied between said transfer means and the image conveying member; and control means for controlling said image forming means on the basis of detection results of said detecting means so that the toner amount of the solid toner image formed on the image conveying member is changed, wherein the detection results are a voltage detection result in each of the first test modes in which the predetermined toner amounts of the solid toner images are different from each other and a voltage detection result in the second test mode.

* * * * *